US005252419A

United States Patent [19]

Kato et al.

[11] Patent Number: 5,252,419

[45] Date of Patent: * Oct. 12, 1993

[54] ELECTROPHOTOGRAPHIC LIGHT-SENSITIVE MATERIAL COMPRISING RESIN CONTAINING ACIDIC GROUPS AT RANDOM AND COMB-LIKE RESIN CONTAINING MACROMONOMER COMPRISING AB BLOCK COPOLYMER

[75] Inventors: Eiichi Kato; Seishi Kasai; Kazuo Ishii, all of Shizuoka, Japan

[73] Assignee: Fuji Photo Film Co., Ltd., Kanagawa, Japan

[ * ] Notice: The portion of the term of this patent subsequent to Aug. 4, 2009 has been disclaimed.

[21] Appl. No.: 704,248

[22] Filed: May 22, 1991

[30] Foreign Application Priority Data

May 22, 1990 [JP] Japan ..... 2-130146

[51] Int. Cl.[5] ..... G03G 5/087

[52] U.S. Cl. ..... 430/96; 430/127

[58] Field of Search ..... 430/96, 127; 526/326

[56] References Cited

U.S. PATENT DOCUMENTS 4,933,246 6/1990 Teuscher ..... 430/96

5,021,311 6/1991 Kato et al. ..... 430/96

*Primary Examiner*—John Goodrow

*Attorney, Agent, or Firm*—Sughrue, Mion, Zinn, Macpeak & Seas

[57] ABSTRACT

An electrophotographic light-sensitive material comprising a support having provided thereon a photoconductive layer containing at least an inorganic photoconductive substance, a spectral sensitizer and a binder resin, wherein the binder resin contains (1) at least one resin (Resin (A)) which contains at least 30% by weight of a polymer component represented by the general formula (I) and a polymer component containing at least one acidic group selected from (wherein R represents a hydrocarbon group or —OR') and a cyclic acid anhydride-containing group, and which has at least one acidic group selected from the above-mentioned acidic groups at one terminal of the main chain of the copolymer;

(I)

and (2) at least one graft type copolymer (Resin (B)) formed from at least one monofunctional macromonomer (M) and comprising an AB block copolymer composed of an A block comprising at least one polymer component containing at least one acidic group selected from and a cyclic acid anhydride-containing group, and a B block containing at least one polymer component represented by the general formula (III) having a polymerizable double bond group bonded to the terminal of the main chain of the B block polymer.

(III)

$X_1$ represents and $R_{21}$ represents a hydrocarbon group, provided that, when $X_1$ represents $R_{21}$ represents a hydrogen atom or a hydrocarbon group.

14 Claims, No Drawings

ELECTROPHOTOGRAPHIC LIGHT-SENSITIVE MATERIAL COMPRISING RESIN CONTAINING ACIDIC GROUPS AT RANDOM AND COMB-LIKE RESIN CONTAINING MACROMONOMER COMPRISING AB BLOCK COPOLYMER

FIELD OF THE INVENTION

The present invention relates to an electrophotographic light-sensitive material, and more particularly to an electrophotographic light-sensitive material which is excellent in electrostatic charging characteristics and pre-exposure fatigue resistance.

BACKGROUND OF THE INVENTION

An electrophotographic light-sensitive material may have various structures depending upon the characteristics required or an electrophotographic process being employed.

An electrophotographic system in which the light-sensitive material comprises a support having thereon at least one photoconductive layer and, if desired, an insulating layer on the surface thereof is widely employed. The electrophotographic light-sensitive material comprising a support and at least one photoconductive layer formed thereon is used for the image formation by an ordinary electrophotographic process including electrostatic charging, imagewise exposure, development, and, if desired, transfer.

Furthermore, a process of using an electrophotographic light-sensitive material as an offset master plate for direct plate making is widely practiced.

Binders which are used for forming the photoconductive layer of an electrophotographic light-sensitive material are required to be excellent in the film-forming property by themselves and the capability of dispersing a photoconductive powder therein. Also, the photoconductive layer formed using the binder is required to have satisfactory adhesion to a base material or support. Further, the photoconductive layer formed by using the binder is required to have various excellent electrostatic characteristics such as high charging capacity, small dark decay, large light decay, and less fatigue due to pre-exposure and also have an excellent image forming properties, and the photoconductive layer stably maintaining these electrostatic characteristics in spite of the fluctuation of humidity at the time of image formation.

Binder resins which have been conventionally used include silicone resins (e.g., JP-B-34-6670) (the term "JP-B" as used herein means an "examined Japanese patent publication"), styrene-butadiene resins (e.g., JP-B-35-1960), alkyd resins, maleic acid resins, polyamides (e.g., JP-B-35-11219), vinyl acetate resins (e.g., JP-B-41-2425), vinyl acetate copolymers (e.g., JP-B-41-2426), acrylic resins (JP-B-35-11216), and acrylic acid ester copolymers (e.g., JP-B-35-11219, JP-B-36-8510, and JP-B-41-13946).

However, in the electrophotographic light-sensitive materials using these binder resins, there are various problems such as 1) the affinity of the binder resin with a photoconductive powder is poor thereby reducing the dispersibility of the coating composition containing them, 2) the charging property of the photoconductive layer containing the binder resin is low, 3) the quality (in particular, dot image reproducibility and resolving power) of the image portions of duplicated images is poor, 4) the image quality is liable to be influenced by the environmental conditions (e.g., high temperature and high humidity or low temperature and low humidity) at the time of the formation of the duplicated image, and 5) the photoconductive layer is insufficient in film strength and adhesion to the support, which causes, when the light-sensitive material is used for an offset master, peeling off of the photoconductive layer at offset printing, resulting in decrease in the number of prints.

In order to improve electrostatic characteristics of the photoconductive layer, various attempts have hitherto been made. For example, incorporation of a compound having an aromatic ring or a furan ring containing a carboxy group or a nitro group either alone or in combination with a dicarboxylic anhydride in a photoconductive layer is disclosed in JP-B-42-6878 and JP-B-45-3073. However, the thus improved electrophotographic light-sensitive materials are yet insufficient in electrostatic characteristics and, in particular, light-sensitive materials having excellent light decay characteristics have not yet been obtained. Thus, for compensating the insufficient sensitivity of these light-sensitive materials, an attempt has been made to incorporate a large amount of a sensitizing dye into the photoconductive layer. However, light-sensitive materials containing a large amount of a sensitizing dye undergo considerable deterioration of whiteness to reduce the quality as a recording medium, and sometimes causing deterioration in dark decay characteristics, whereby satisfactory reproduced images are not obtained.

On the other hand, JP-A-60-10254 (the term "JP-A" as used herein means an "unexamined published Japanese patent application") discloses a method of using a binder resin for a photoconductive layer by controlling an average molecular weight of the resin. More specifically, JP-A-60-10254 discloses a technique for improving the electrostatic characteristics (in particular, reproducibility at repeated use as a PPC light-sensitive material) and moisture resistance of the photoconductive layer by using an acrylic resin having an acid value of from 4 to 50 and an average molecular weight of from $1\times10^3$ to $1\times10^4$ and an acrylic resin having an acid value of from 4 to 50 and an average molecular weight of from $1\times10^4$ to $2\times10^5$ in combination.

Furthermore, extensive investigations on lithographic printing plate precursors using electrophotographic light-sensitive materials have been made and various binder resins for a photoconductive layer have been proposed as satisfying both the electrostatic characteristics as an electrophotographic light-sensitive material and the printing characteristics as a printing plate precursor. For example, JP-B-50-31011 discloses a combination of a resin having a molecular weight of from $1.8\times10^4$ to $10\times10^4$ and a glass transition point (Tg) of from 10° to 80° C. obtained by copolymerization of a (meth)acrylate monomer and other monomers in the presence of fumaric acid and a copolymer composed of a (meth)acrylate monomer and a copolymerizable monomer other than fumaric acid, JP-A-53-54027 discloses a terpolymer containing a (meth)acrylic acid ester unit with a substituent having a carboxylic acid group at least 7 atoms apart from the ester linkage, JP-A-54-20735 and JP-A-57-202544 disclose a tetra- or pentapolymer containing an acrylic acid unit and a hydroxyethyl (meth)acrylate unit, and JP-A-58-68046 discloses a terpolymer containing a (meth)acrylic acid ester unit with an alkyl group having from 6 to 12 carbon atoms as a substituent and a vinyl monomer containing a carboxyl group as effective for improving oil-desensitizing property of the photoconductive layer.

However, when the above described resins effective for improving electrostatic characteristics, moisture resistance and durability are practically used, it is found that they have problems in electrostatic characteristics, particularly charging property, dark charge retention characteristic and photosensitivity, and smoothness of the photoconductive layer, and they are still insufficient.

Also, as the result of evaluations on the binder resins which have been developed for electrophotographic lithographic printing plate precursors, it has been found that they have problems in the above-described electrostatic characteristics and background stains of prints.

For solving these problems, JP-A-63-217354 discloses a resin having a weight average molecular weight of from $1\times10^3$ to $1\times10^4$ and containing from 0.05 to 10% by weight of a copolymerizable component having an acidic group in the side chain of the copolymer as a binder resin, JP-A-1-100554 discloses a binder resin further containing a curable group-containing copolymerizable component together with the above-described acidic group-containing copolymerizable component, JP-A-1-102573 discloses a binder resin using a crosslinking agent together with the above-described acidic group-containing resin, JP-A-63-220149, JP-A-63-220148, and JP-A-64-564 disclose a binder resin using a high molecular weight resin having a weight average molecular weight of at least $1\times10^4$ in combination with the above-described acidic group-containing resin, and JP-A-1-102573, JP-A-2-34860, JP-A-2-40660, JP-A-2-53064 and JP-A-2-56558 disclose a binder resin using a heat- and/or photo-curable resin, a partially crosslinked polymer or a comb-like copolymer in combination with the above-described acidic group-containing resin.

On the other hand, as other binder resins for electrophotographic light-sensitive materials for solving the above-described problems, JP-A-1-70761 discloses a binder resin using a resin having a weight average molecular weight of from $1\times10^3$ to $1\times10^4$ having an acidic group at the terminal of the polymer main chain, JP-A-1-214865 discloses a binder resin using the above-described resin further containing a curable group-containing component as a copolymerizable component, JP-A-2-874 discloses a binder resin using a cross-linking agent together with the above-described resin, JP-A-1-280761, JP-A-1-116643, and JP-A-1-169455 disclose a binder resin using a high molecular weight resin having a weight average molecular weight of at least $1\times10^4$ in combination with the above-described resin, and JP-A-2-34859, JP-A-2-96766 and JP-A-2-103056 disclose a binder resin using a heat- and photo-curable resin, a partially crosslinked polymer or a comb-like copolymer in combination with the above-described resin.

However, it has been found that these resins still have problems in maintenance of the stable high performance when the electrophotographic light-sensitive materials are exposed to noticeably severe conditions.

More specifically, it has been found that, when a charging speed is increased in a charging step of the light-sensitive material, uneven charging occurs, which results in causing unevenness in the duplicated images, or, when a duplicating operation is carried out immediately after irradiating the surface of the electrophotographic light-sensitive material with the light such as that of a fluorescent lamp, as a supplemental operation for a copying machine, the duplicated images obtained are deteriorated (in particular, decrease in image density, lowering of resolving power, and the occurrence of background fog) (so-called pre-exposure fatigue).

Furthermore, when the electrophotographic light-sensitive material described above is used as a lithographic printing plate precursor by an electrophotographic system, the resulting printing plate has the duplicated images of deteriorated image quality in the case of carrying out the duplication under the above-described condition, and, when printing is conducted using the plate, serious problems may occur such as degradation of image quality and the occurrence of background stains.

SUMMARY OF THE INVENTION

The present invention has been made for solving the above described problems of conventional electrophotographic light-sensitive materials.

An object of the present invention is, therefore, to provide a CPC electrophotographic light-sensitive material having improved electrostatic charging characteristics and pre-exposure fatigue resistance.

Another object of the present invention is to provide a lithographic printing plate precursor by an electrophotographic system capable of providing a number of prints having clear images.

Other objects of the present invention will become apparent from the following description and examples.

It has now been found that the above-described objects of the present invention are accomplished by an electrophotographic light-sensitive material comprising a support having provided thereon a photoconductive layer containing at least an inorganic photoconductive substance, a spectral sensitizer and a binder resin, wherein the binder resin contains (1) at least one resin (Resin (A)) having a weight average molecular weight of from $1\times10^3$ to $1\times10^4$ which contains at least 30% by weight of a polymer component represented by the general formula (I) described below and from 0.1 to 10% by weight of a polymer component containing at least one acidic group selected from $$-PO_3H_2,\ -SO_3H,\ -COOH,\ -\overset{\overset{\displaystyle O}{\|}}{\underset{\underset{\displaystyle OH}{|}}{P}}-R$$

(wherein R represents a hydrocarbon group or —OR' (wherein R' represents a hydrocarbon group) and a cyclic acid anhydride-containing group, and which has at least one acidic group selected from the above-described acidic groups at one terminal of the main chain of the copolymer;

$$\left(\overset{\overset{\displaystyle a_1}{|}}{CH}-\overset{\overset{\displaystyle a_2}{|}}{\underset{\underset{\displaystyle COO-R_1}{|}}{C}}\right) \qquad (I)$$

wherein $a_1$ and $a_2$ each represents a hydrogen atom, a halogen atom, a cyano group or a hydrocarbon group; and $R_1$ represents a hydrocarbon group; and (2) at least one graft type copolymer (Resin (B)) having a weight average molecular weight of from $3\times10^4$ to $1\times10^6$ and formed from as a copolymerizable component, at least one monofunctional macromonomer (M) having a weight average molecular weight of from $1\times10^3$ to $2\times10^4$ and comprising an AB block copolymer composed of an A block comprising at least one polymer component containing at least one acidic group selected from $$-PO_3H_2,\ -COOH,\ -SO_3H,\ -OH,\ -\overset{\overset{O}{\|}}{\underset{\underset{R_0}{|}}{P}}-OH$$

(wherein $R_0$ represents a hydrocarbon group or $-OR_0'$ (wherein $R_0'$ represents a hydrocarbon group)) and a cyclic acid anhydride-containing group, and a B block containing at least one polymer component represented by the general formula (III) described below and having a polymerizable double bond group bonded to the terminal of the main chain of the B block polymer.

$$\left(\overset{c_1}{\underset{}{CH}}-\overset{c_2}{\underset{\underset{X_1-R_{21}}{|}}{C}}\right) \quad \text{(III)}$$

wherein $c_1$ and $c_2$ each represents a hydrogen atom, a halogen atom, a cyano group, a hydrocarbon group, $-COOR_{24}$ or $-COOR_{24}$ bonded via a hydrocarbon group (wherein $R_{24}$ represents a hydrocarbon group); $X_1$ represents $$-COO-,\ -OCO-,\ -(CH_2)_{l_1}OCO-,\ -(CH_2)_{l_2}COO-$$

(wherein $l_1$ and $l_2$ each represents an integer of from 1 to 3), $$-O-,\ -SO_2-,\ -CO-,\ -\overset{\overset{R_{23}}{|}}{CON}-,\ -\overset{\overset{R_{23}}{|}}{SO_2N}-$$

(wherein $R_{23}$ represents a hydrogen atom or a hydrocarbon group), $$-CONHCOO-,\ -CONHCONH-,\ \text{or}$$

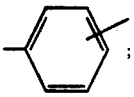

;

and $R_{21}$ represents a hydrocarbon group, provided that, when $X_1$ represents

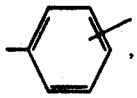

, $R_{21}$ represents a hydrogen atom or a hydrocarbon group.

DETAILED DESCRIPTION OF THE INVENTION

The binder resin which can be used in the present invention comprises at least (1) a low-molecular weight resin (hereinafter referred to as resin (A)) containing a polymer component having the specific repeating unit and a polymer component having the specific acidic group (hereinafter, the term "acidic group" used in the present invention includes a cyclic acid anhydride-containing group, unless otherwise indicated) and having an acidic group at one terminal of the polymer main chain and (2) a high-molecular weight resin (hereinafter referred to as resin (B)) composed of a graft type copolymer formed of, as a polymerizable component, at least one monofunctiunal macromonomer (M) comprising an AB block copolymer composed of an A block comprising a polymer component containing the specific acidic group described above and a B block comprising a polymer component represented by the general formula (III) described above and having a polymer double bond group bonded to the terminal of the main chain of the B block polymer.

As described above, it is known that a resin containing an acidic group-containing polymerizable component and a resin having an acidic group at the terminal of the main chain thereof are known as a binder resin for an electrophotographic light-sensitive material, but, as described in the present invention, it has been surprisingly found that the above-described problems in conventional techniques can be first solved by using the resin having the acidic groups not only in the side chain of the polymer but also at the terminal of the polymer main chain.

According to a preferred embodiment of the present invention, the low-molecular weight resin (A) is a low molecular weight resin (hereinafter sometimes referred to as resin (A')) having the acidic group at the terminal and containing the acidic group-containing component and a methacrylate component having a specific substituent containing a benzene ring or a naphthalene ring represented by the following general formula (IIa) or (IIb):

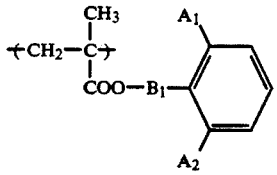

(IIa)

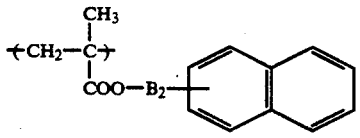

(IIb)

wherein $A_1$ and $A_2$ each represents a hydrogen atom, a hydrocarbon group having from 1 to 10 carbon atoms, a chlorine atom, a bromine atom, $-COD_1$ or $-COOD_2$, wherein $D_1$ and $D_2$ each represents a hydrocarbon group having from 1 to 10 carbon atoms; and $B_1$ and $B_2$ each represents a mere bond or a linking group containing from 1 to 4 linking atoms, which connects —COO— and the benzene ring.

According to another preferred embodiment of the present invention, the high-molecular weight resin (B) is a graft type copolymer containing at least one macromonomer (M) described above and a polymer component represented by the following general formula (IV):

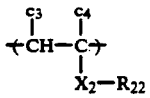

(IV)

wherein $c_3$, $c_4$, $X_2$ and $R_{22}$ each has the same meaning as defined for $c_1$, $c_2$, $X_1$ and $R_{21}$ in the general formula (III) above.

In the present invention, it has been found that, in the dispersion system containing at least an inorganic photoconductive substance and a spectral sensitizer, the low-molecular weight resin (A) effectively adsorbs onto the stoichiometric defects of the photoconductive substance without hindering the adsorption of the spectral sensitizer onto the inorganic photoconductive substance, can adequately improve the coating property on the surface of the photoconductive substance, compensates the traps of the photoconductive substance, ensures the sensitivity increasing effect of the photoconductive substance with the spectral sensitizer, greatly improves the moisture resistance, and further sufficiently disperses the photoconductive substance to inhibit the occurrence of aggregation of the photoconductive substance.

Also, the resin (B) serves to sufficiently highten the mechanical strength of the photoconductive layer which may be insufficient in case of using the resin (A) alone, without damaging the excellent electrophotographic characteristics attained by the use of the resin (A).

It is believed that, by specifying the weight average molecular weight of each of the resin (A) and the resin (B) and the contents and the positions of the acidic groups bonded in the resins as the binder resin for the inorganic photoconductive substance according to the present invention, the strength of the interaction of the inorganic photoconductive substance, spectral sensitizer and resins can be properly changed in the dispersed state of these components and the dispersion state can be stably maintained.

Thus, it is believed that, for the reasons described above, the electrostatic charging characteristics are improved, uneven charging does not occur, and the pre-exposure fatigue resistance is improved.

In case of using the resin (A'), the electrophotographic characteristics, particularly, $V_{10}$, DRR and $E_{1/10}$ of the electrophotographic material can be furthermore improved as compared with the use of the resin (A). While the reason for this fact is not fully clear, it is believed that the polymer molecular chain of the resin (A') is suitably arranged on the surface of inorganic photoconductive substance such as zinc oxide in the layer depending on the plane effect of the benzene ring or the naphthalene ring which is an ester component of the methacrylate whereby the above described improvement is achieved.

Also, in the present invention, the smoothness of surface of the photoconductive layer can be improved. When an electrophotographic light-sensitive material having a photoconductive layer of rough surface is used as a lithographic printing plate precursor by an electrophotographic system, since the dispersion state of inorganic particles as a photoconductive substance and a binder resin is improper and the photoconductive layer is formed in a state containing aggregates thereof, whereby when the photoconductive layer is subjected to an oil-desensitizing treatment with an oil-desensitizing solution, the non-image areas are not uniformly and sufficiently rendered hydrophilic to cause attaching of printing ink at printing, which results in causing background stains at the non-image portions of the prints obtained.

In the case of using the binder resin according to the present invention, the interaction of the adsorption and coating of the inorganic photoconductive substance and the binder resin is adequately performed, and the film strength of the photoconductive layer is maintained.

Moreover, since the deterioration of the image quality and the formation of the background fog caused by uneven charging or pre-exposure fatigue do not occur, prints having remarkably excellent images can be obtained when the electrophotographic light-sensitive material of the present invention is used as a lithographic printing plate precursor.

In the resin (A), the weight average molecular weight is from $1\times10^3$ to $1\times10^4$, and preferably from $3\times10^3$ to $8\times10^3$, the content of the polymer component corresponding to the repeating unit represented by the general formula (I) is at least 30% by weight, and preferably from 50 to 97% by weight. The total content of the acidic groups in the acidic group-containing copolymer component and the acidic group bonded to the terminal of the main chain is preferably from 1 to 20% by weight. Furthermore, the content of the copolymer component containing the acidic group is preferably from 0.1 to 10% by weight, and more preferably from 0.5 to 8% by weight, and the content of the acidic group bonded to the terminal of the main chain is preferably from 0.5 to 15% by weight, and more preferably from 1 to 10% by weight.

Also, the content of the copolymer component of the methacrylate corresponding to the repeating unit represented by the general formula (IIa) and/or (IIb) in the resin (A') is at least 30% by weight, and preferably from 50 to 97% by weight, and the content of the copolymer component containing the acidic group is preferably from 0.1 to 10% by weight, and more preferably from 0.5 to 8% by weight. Also, the content of the acidic group bonded to the terminal of the polymer chain is preferably from 0.5 to 15% by weight, and more preferably from 1 to 10% by weight.

The glass transition point of the resin (A) is preferably from −20° C. to 110° C., and more preferably from −10° C. to 90° C.

On the other hand, the weight average molecular weight of the resin (B) is from $3\times10^4$ to $1\times10^6$, and more preferably from $5\times10^4$ to $5\times10^5$.

The content of the monofunctional macromonomer comprising an AB block copolymer component in the resin (B) is preferably from 1 to 60% by weight, more preferably from 5 to 50% by weight, and the content of the polymer component represented by the general formula (IV) is preferably from 40 to 99% by weight, more preferably from 50 to 95% by weight.

The glass transition point of the resin (B) is preferably from 0° C. to 110° C., and more preferably from 20° C. to 90° C.

If the molecular weight of the resin (A) is less than $1\times10^3$, the film-forming property thereof is reduced, and a sufficient film strength cannot be maintained. On the other hand, if the molecular weight of the resin (A) is higher than $1\times10^4$, the fluctuations of the electrophotographic characteristics (charging property and pre-exposure fatigue resistance) under the above-described severe conditions become somewhat larger, and the effect of the present invention for obtaining stable duplicated images is reduced.

If the total content of the acidic groups in the resin (A) is less than 1% by weight, the initial potential is low and a sufficient image density cannot be obtained. On the other hand, if the total acidic group content is larger than 20% by weight, the dispersibility is reduced even if the molecular weight of the resin (A) is low, the smoothness of the layer and the electrophotographic characteristics at high humidity are reduced, and further, when the light-sensitive material is used as an offset master plate, the occurrence of background stains is increased.

If the molecular weight of the resin (B) is less than $3\times10^4$, a sufficient film strength may not be maintained. On the other hand, if the molecular weight thereof is larger than $1\times10^6$, the dispersibility of the photoconductive substance is reduced, the smoothness of the photoconductive layer is deteriorated, and the image quality of duplicated images (particularly, the reproducibility of fine lines and letters) degrades. Further, the background stains increase in case of using as an offset master plate.

Further, if the content of the macromonomer is less than 1% by weight in the resin (B), electrophotographic characteristics (particularly dark decay retention rate and photosensitivity) may be reduced and the fluctuations of electrophotographic characteristics of the photoconductive layer, particularly that containing a spectral sensitizing dye for the sensitization in the range of from near-infrared to infrared become large under severe conditions. The reason therefor is considered that the construction of the polymer becomes similar to that of a conventional homopolymer or random copolymer resulting from the slight amount of macromonomer portion present therein.

On the other hand, if the content of the macromonomer is more than 60% by weight, the copolymerizability of the macromonomer with other monomers corresponding to other copolymer components may become insufficient, and the sufficient electrophotographic characteristics can not be obtained as the binder resin.

Now, the resin (A) and the resin (B) which can be used in the present invention will be explained in detail below.

The resin (A) used in the present invention contains at least one repeating unit represented by the general formula (I) as a polymer component as described above.

In the general formula (I), $a_1$ and $a_2$ each represents a hydrogen atom, a halogen atom (e.g., chlorine and bromine), a cyano group or a hydrocarbon group, preferably including an alkyl group having from 1 to 4 carbon atoms (e.g., methyl, ethyl, propyl and butyl). $R_1$ preferably represents an alkyl group having from 1 to 18 carbon atoms which may be substituted (e.g., methyl, ethyl, propyl, butyl, pentyl, hexyl, octyl, decyl, dodecyl, tridecyl, tetradecyl, 2-chloroethyl, 2-bromoethyl, 2-cyanoethyl, 2-hydroxyethyl, 2-methoxyethyl, 2-ethoxyethyl, and 3-hydroxypropyl), an alkenyl group having from 2 to 18 carbon atoms which may be substituted (e.g., vinyl, allyl, isopropenyl, butenyl, hexenyl, heptenyl, and octenyl), an aralkyl group having from 7 to 12 carbon atoms which may be substituted (e.g., benzyl, phenethyl, naphthylmethyl, 2-naphthylethyl, methoxybenzyl, ethoxybenzyl, and methylbenzyl), a cycloalkyl group having from 5 to 8 carbon atoms which may be substituted (e.g., cyclopentyl, cyclohexyl, and cycloheptyl), or an aryl group which may be substituted (e.g., phenyl, tolyl, xylyl, mesityl, naphthyl, methoxyphenyl, ethoxyphenyl, fluorophenyl, difluorophenyl, bromophenyl, chlorophenyl, dichlorophenyl, iodophenyl, methoxycarbonylphenyl, ethoxycarbonylphenyl, cyanophenyl, and nitrophenyl).

More preferably, the polymer component corresponding to the repeating unit represented by the general formula (I) is a methacrylate component having the specific aryl group represented by the general formula (IIa) and/or (IIb) (Resin (A')) described above.

In the general formula (IIa), $A_1$ and $A_2$ each preferably represents a hydrogen atom, a chlorine atom, a bromine atom, a hydrocarbon group (preferably, an alkyl group having from 1 to 4 carbon atoms (e.g., methyl, ethyl, propyl, and butyl), an aralkyl group having from 7 to 9 carbon atoms which may be substituted (e.g., benzyl, phenethyl, 3-phenylpropyl, chlorobenzyl, dichlorobenzyl, bromobenzyl, methylbenzyl, methoxybenzyl, and chloromethylbenzyl), an aryl group which may be substituted (e.g., phenyl, tolyl, xylyl, bromophenyl, methoxyphenyl, chlorophenyl, and dichlorophenyl), $-COD_1$ or $-COOD_2$, wherein $D_1$ and $D_2$ each preferably represent any of the above-recited hydrocarbon groups as preferred hydrocarbon groups for $A_1$ and $A_2$.

In the general formula (IIa), $B_1$ is a mere bond or a linking group containing from 1 to 4 linking atoms, e.g., $-CH_2)_{n1}$ ($n_1$ represents an integer of 1, 2 or 3), $-CH_2OCO-$, $-CH_2CH_2OCO-$, $-CH_2O)_{n2}$ ($n_2$ represents an integer of 1 or 2), and $-CH_2CH_2O-$, which connects —COO— and the benzene ring.

In the general formula (IIb), $B_2$ has the same meaning as $B_1$ in the general formula (Ia).

Specific examples of the copolymer component corresponding to the repeating unit represented by the general formula (IIa) or (IIb) which can be used in the resin (A') according to the present invention are described below, but the present invention should not be construed as being limited thereto. In the following formulae, $T_1$ and $T_2$ each represent Cl, Br or I; $R_{11}$ represents $-C_aH_{2a+1}$ or

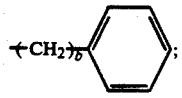

a represents an integer of from 1 to 4; b represents an integer of from 0 to 3; and c represents an integer of from 1 to 3.

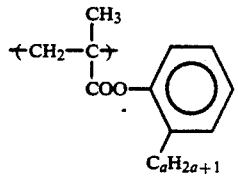

i-1)

-continued
i-2)
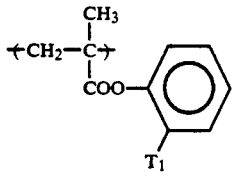
i-3)
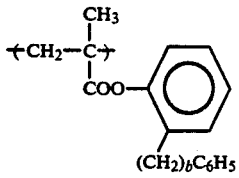
i-4)
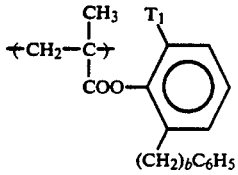
i-5)
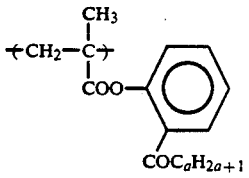
i-6)
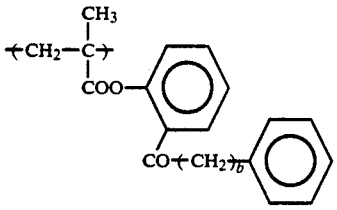
i-7)
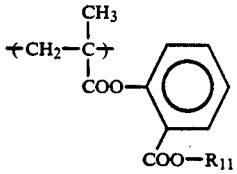
i-8)
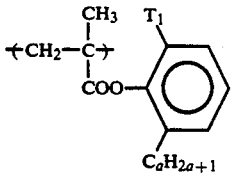
i-9)
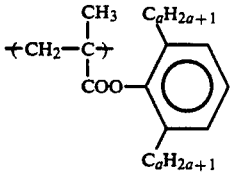
-continued
i-10)
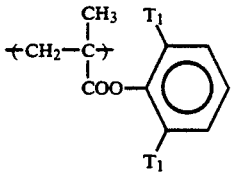
i-11)
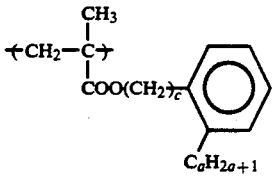
i-12)
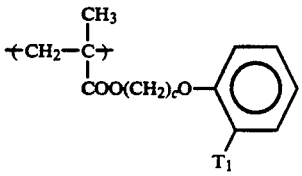
i-13)
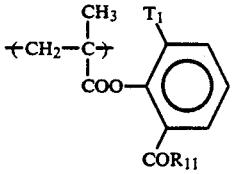
i-14)
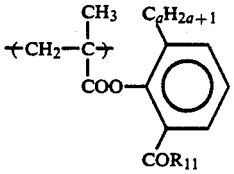
i-15)
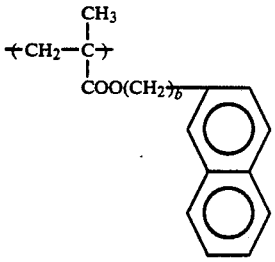
i-16)
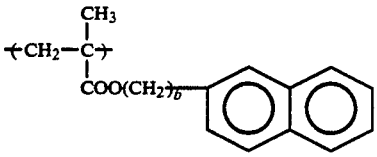
i-17)
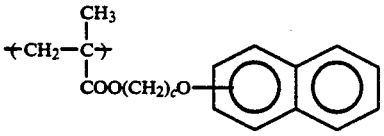
i-18)
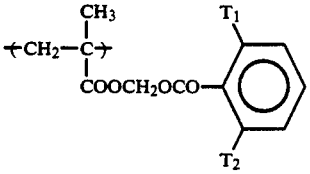

-continued

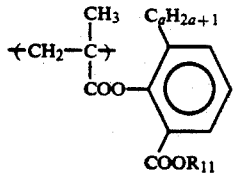

i-19)

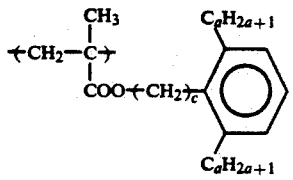

i-20)

As a copolymerizable monomer corresponding to the component containing the acidic group contained in the resin (A) used in the present invention, any vinyl compound having the acidic group capable of copolymerization with the monomer corresponding to the repeating unit represented by the general formula (I) (including the repeating unit represented by the general formula (IIa) or (IIb)) may be used.

For example, such vinyl compounds are described in *Macromolecular Data Handbook* (*Foundation*), edited by Kobunshi Gakkai, Baifukan (1986). Specific examples of the vinyl compound are acrylic acid, α- and/or β-substituted acrylic acid (e.g., α-acetoxy compound, α-acetoxymethyl compound, α-(2-amino)ethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and ester derivatives or amide derivatives of these carboxylic acids or sulfonic acids having the acidic group in the substituent thereof.

In the

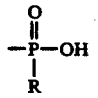

group as an acidic group, R represents a hydrocarbon group or a —OR′ group (wherein R′ represents a hydrocarbon group), and, preferably, R and R′ each represents an aliphatic group having from 1 to 22 carbon atoms which may be substituted (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and an aryl group which may be substituted (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl).

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,-2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphtnalenedicarboxylic acid anhydride ring, pyridinedicarboxylic acid anhydride ring and thiophenedicarboxyic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

Specific examples of the copolymer components having the acidic group are illustrated below, but the present invention should not be construed as being limited thereto.

In the following formulae, $P_1$ represents H or $CH_3$; $P_2$ represents H, $CH_3$, or $CH_2COOCH_3$; $R_{12}$ represents an alkyl group having from 1 to 4 carbon atoms; $R_{13}$ represents an alkyl group having from 1 to 6 carbon atoms, a benzyl group, or a phenyl group; c represents an integer of from 1 to 3; d represents an integer of from 2 to 11; e represents an integer of from 1 to 11; f represents an integer of from 2 to 4; and g represents an integer of from 2 to 10.

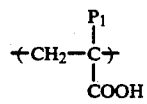

ii-1)

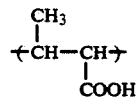

ii-2)

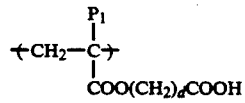

ii-3)

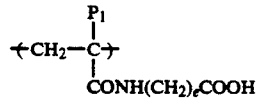

ii-4)

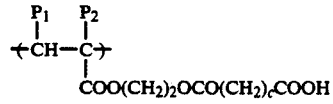

ii-5)

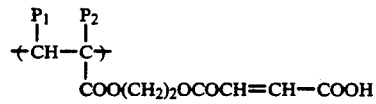

ii-6)

-continued
ii-7)
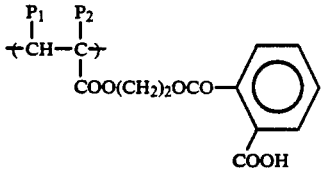
ii-8)
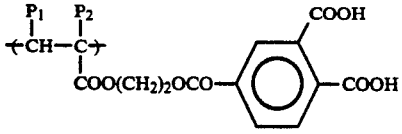
ii-9)
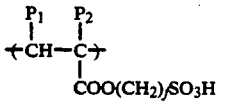
ii-10)
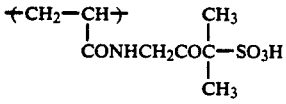
ii-11)
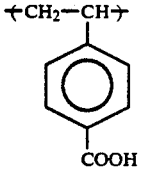
ii-12)
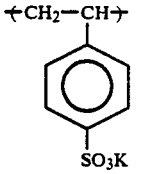
ii-13)
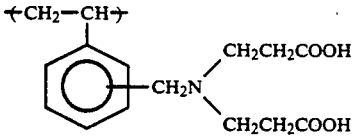
ii-14)
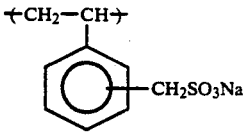
ii-15)
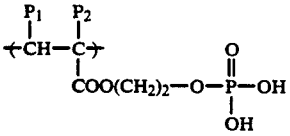
ii-16)
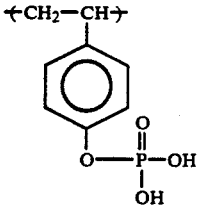
-continued
ii-17)
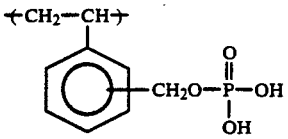
ii-18)
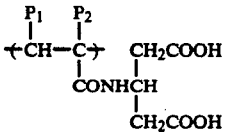
ii-19)
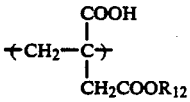
ii-20)
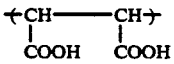
ii-21)
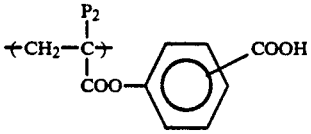
ii-22)
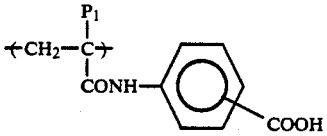
ii-23)
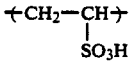
ii-24)
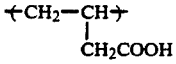
ii-25)
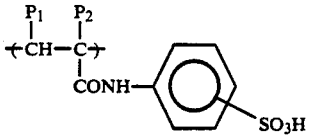
ii-26)
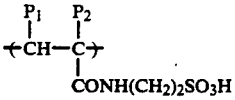
ii-27)
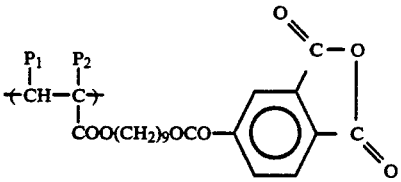
ii-28)
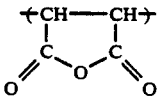
ii-29
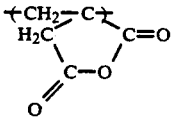

-continued ii-30)

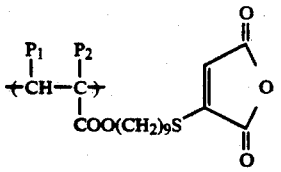

ii-31)

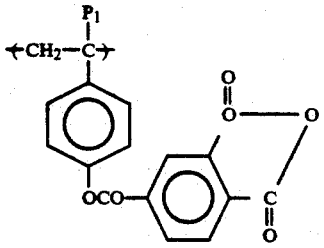

ii-32)

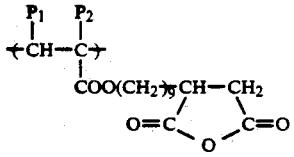

ii-33)

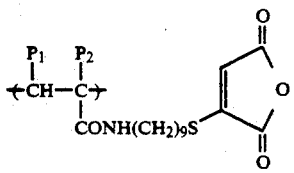

ii-34)

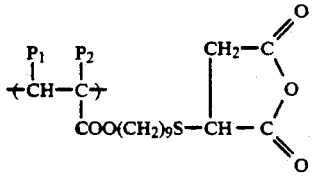

ii-35)

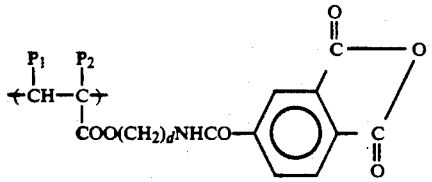

ii-36)

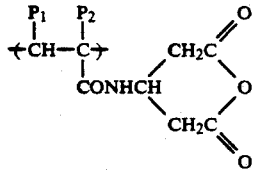

ii-37)

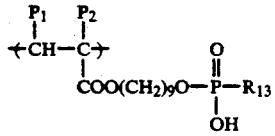

ii-38)

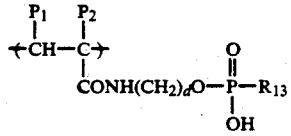

In the resin (A), the above-described acidic group contained in the copolymer component of the polymer may be the same as or different from the acidic group bonded to the terminal of the polymer main chain.

The acidic group which is bonded to one of the terminals of the polymer main chain in the resin (A) according to the present invention includes

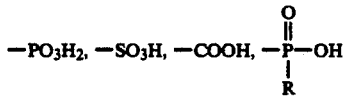

(wherein R is as defined above), and a cyclic acid anhydride-containing group.

The above-described acidic group may be bonded to one of the polymer main chain terminals either directly or via an appropriate linking group.

The linking group can be any group for connecting the acidic group to the polymer main chain terminal. Specific examples of suitable linking group include

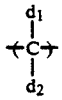

(wherein $d_1$ and $d_2$, which may be the same or different, each represents a hydrogen atom, a halogen atom (e.g., chlorine, and bromine), a hydroxyl group, a cyano group, an alkyl group (e.g., methyl, ethyl, 2-chloroethyl, 2-hydroxyethyl, propyl, butyl, and hexyl), an aralkyl group (e.g., benzyl, and phenethyl), an aryl group (e.g., phenyl)),

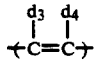

(wherein $d_3$ and $d_4$ each has the same meaning as defined for $d_1$ or $d_2$ above),

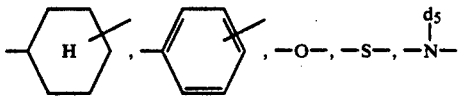

(wherein $d_5$ represents a hydrogen atom or a hydrocarbon group preferably having from 1 to 12 carbon atoms (e.g., methyl, ethyl, propyl, butyl, hexyl, octyl, decyl, dodecyl, 2-methoxyethyl, 2-chloroethyl, 2-cyanoethyl, benzyl, methylbenzyl, chlorobenzyl, methoxybenzyl, phenethyl, phenyl, tolyl, chlorophenyl, methoxyphenyl, and butylphenyl),

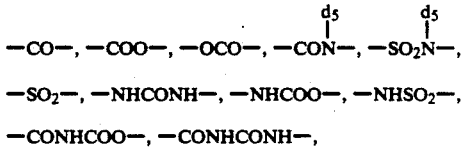

a heterocyclic ring (preferably a 5-membered or 6-membered ring containing at least one of an oxygen atom, a sulfur atom and a nitrogen atom as a hetero atom or a condensed ring thereof (e.g., thiophene, pyridine, furan, imidazole, piperidine, and morpholine)),

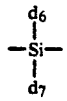

(wherein $d_6$ and $d_7$, which may be the same or different, each represents a hydrocarbon group or —$Od_8$ (wherein $d_8$ represents a hydrocarbon group)), and a combination thereof. Suitable example of the hydrocarbon group represented by $d_6$, $d_7$ or $d_8$ include those described for $d_5$.

Moreover, the resin (A) preferably contains from 1 to 20% by weight of a copolymer component having a heat- and/or photo-curable functional group in addition to the copolymer component represented by the general formula (I) (including that represented by the general formula (IIa) or (IIb)) and the copolymer component having the acidic group described above, in view of achieving higher mechanical strength.

The term "heat- and/or photo-curable functional group" as used herein means a functional group capable of inducing curing reaction of a resin on application of at least one of heat and light.

Specific examples of the photo-curable functional group include those used in conventional light-sensitive resins known as photocurable resins as described, for example, in Hideo Inui and Gentaro Nagamatsu, *Kankosei Kobunshi*, Kodansha (1977), Takahiro Tsunoda, *Shin-Kankosei Jushi*, Insatsu Gakkai Shuppanbu (1981), G. E. Green and B. P. Strak, *J. Macro. Sci. Reas. Macro. Chem.*, C 21 (2), pp. 187 to 273 (1981-82), and C. G. Rattey, *Photopolymerization of Surface Coatings*, A. Wiley Interscience Pub. (1982).

The heat-curable functional group which can be used includes functional groups excluding the above-specified acidic groups. Examples of the heat-curable functional groups are described, for example, in Tsuyoshi Endo, *Netsukokasei Kobunshi no Seimitsuka*, C. M. C. (1986), Yuji Harasaki, *Saishin Binder Gijutsu Binran*, Chapter II-I, Sogo Gijutsu Center (1985), Takayuki Ohtsu, *Acryl Jushi no Gosei Sekkei to ShinYotokaihatsu*, Chubu Kei-ei Kaihatsu Center Shuppanbu (1985), and Eizo Ohmori, *Kinosei Acryl Kei Jushi*, Techno System (1985).

Specific examples of the heat-curable functional group which can used include —OH, —SH, —$NH_2$, —$NHR_3$ (wherein $R_3$ represents a hydrocarbon group, for example, an alkyl group having from 1 to 10 carbon atoms which may be substituted (e.g., methyl, ethyl, propyl, butyl, hexyl, octyl, decyl, 2-chloroethyl, 2-methoxyethyl, and 2-cyanoethyl), a cycloalkyl group having from 4 to 8 carbon atoms which may be substituted (e.g., cycloheptyl and cyclohexyl), an aralkyl group having from 7 to 12 carbon atoms which may be substituted (e.g., benzyl, phenethyl, 3-phenylpropyl, chlorobenzyl, methylbenzyl, and methoxybenzyl), and an aryl group which may be substituted (e.g., phenyl, tolyl, xylyl, chlorophenyl, bromophenyl, methoxyphenyl, and naphthyl)),

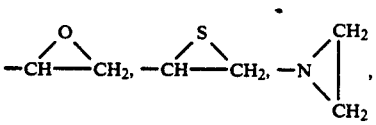

-continued

—$CONHCH_2OR_4$ (wherein $R_4$ represents a hydrogen atom or an alkyl group having from 1 to 8 carbon atoms (e.g., methyl, ethyl, propyl, butyl, hexyl, and octyl), —N=C=O and —C(d9)=C(d10)—CH (wherein $d_9$ and $d_{10}$ each represents a hydrogen atom, a halogen atom (e.g., chlorine and bromine) or an alkyl group having from 1 to 4 carbon atoms (e.g., methyl and ethyl)).

Other examples of the functional group include polymerizable double bond groups, for example, $CH_2=CH-$, $CH_2=CH-CH_2-$, $CH_2=CH-C(=O)-O-$, $CH_2=C(CH_3)-C(=O)-O-$, $CH(CH_3)=CH-C(=O)-O-$, $CH_2=CH-CONH-$, $CH_2=C(CH_3)-CONH-$, $CH(CH_3)=CH-CONH-$, $CH_2=CH-O-C(=O)-$, $CH_2=C(CH_3)-O-C(=O)-$, $CH_2=CH-CH_2-O-C(=O)-$, $CH_2=CH-NHCO-$, $CH_2=CH-CH_2-NHCO-$, $CH_2=CH-SO_2-$, $CH_2=CH-CO-$, $CH_2=CH-O-$, and $CH_2=CH-S-$.

In order to introduce at least one functional group selected from the curable functional groups into the binder resin according to the present invention, a method comprising introducing the functional group into a polymer by a macromolecular reaction or a method comprising copolymerizing at least one monomer containing at least one of the functional groups with a monomer corresponding to the repeating unit of the general formula (I) (including that of the general formula (IIa) or (IIb)) and a monomer correspnding to the acidic group-containing polymer component can be employed.

The above-described macromolecular reaction can be carried out by using conventionally known low molecular synthesis reactions. For the details, reference can be made, for example, to Nippon Kagakukai (ed.), *Shin-Jikken Kagaku Koza*, Vol. 14, "Yuki Kagobutsu no Gosei to Hanno (I) to (V)", Maruzen Co., and Yoshio Iwakura and Keisuke Kurita, *Hannosei Kobunshi*, and literature references cited therein.

Suitable examples of the monomers containing the functional group capable of inducing heat- and/or photocurable reaction include vinyl compounds which are copolymerizable with the monomers corresponding to the repeating unit of the general formula (I) and containing the above-described functional group. More specifically, compounds similar to those described in detail above as the acidic group-containing components which contain the above-described functional group in their substituents are illustrated.

Specific examples of the heat- and/or photocurable functional group-containing repeating unit are described below, but the present invention should not be construed as being limited thereto. In the following formulae, $R_{11}$, a, d and e each has the same meaning as defined above; $P_1$ and $P_3$ each represents —H or —$CH_3$; $R_{14}$ represents —CH=$CH_2$ or —$CH_2CH$=$CH_2$; $R_{15}$ represents

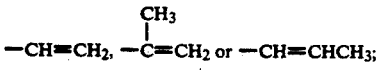

$R_{16}$ represents

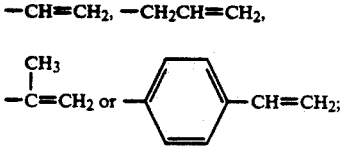

Z represents S or O; $T_3$ represents —OH or —$NH_2$; h represents an integer of from 1 to 11; i represents an integer of from 1 to 10.

iii-1)

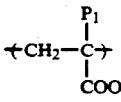

iii-2)

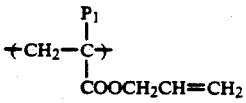

iii-3)

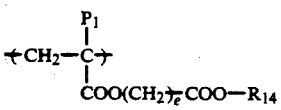

iii-4)

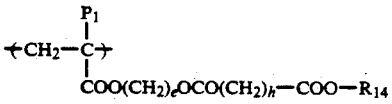

iii-5)

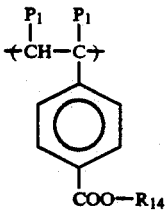

iii-6)

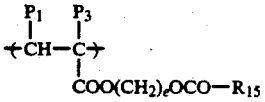

iii-7)

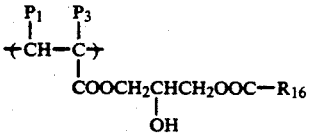

-continued iii-8)

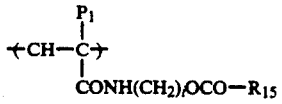

iii-9)

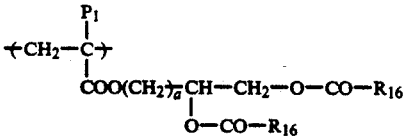

iii-10)

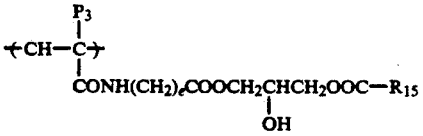

iii-11)

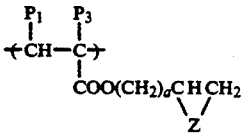

iii-12)

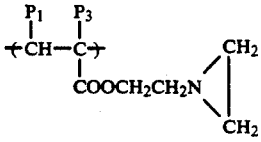

iii-13)

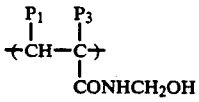

iii-14)

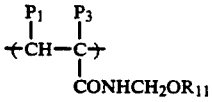

iii-15)

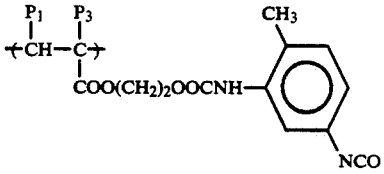

iii-16)

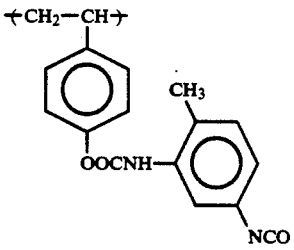

iii-17)

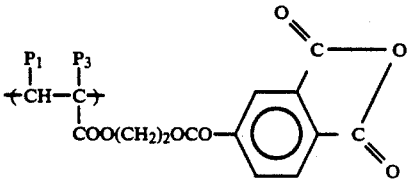

iii-18)

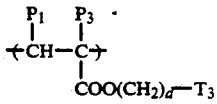

-continued

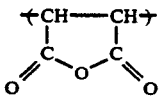

iii-19)

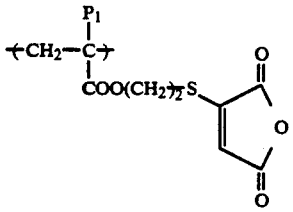

iii-20)

Also, when the resin (A) used in the present invention contains a photo- and/or heat-curable functional group, a crosslinking agent for accelerating the crosslinking of the resin in the layer can be employed together. As the crosslinking agent, compounds which are ordinary used as crosslinking agents can be used. Specifically, these compounds are described, for example, in Shinzo Yamashita and Tosuke Kaneko, *Kakyozai (Crosslinking Agent) Handbook*, Taiseisha (1981), and Kobunshi Gakkai (ed.), *Kobunshi (Polymer) Data Handbook Kisohen (Foundation)*, Baifukan (1986).

Specific examples of the crosslinking agent are organic silane series compounds (e.g., silane coupling agents such as vinyltrimethoxysilane, vinyltributoxysilane, γ-glycidoxypropyltrimethoxysilane, γ-mercaptopropyltriethoxysilane, and γ-aminopropyltriethoxysilane), polyisocyanate series compounds (e.g., toluylene diisocyanate, o-toluylene diisocyanate, diphenylmethane diisocyanate, triphenylmethane triisocyanate, polymethylenepolyphenyl isocyanate, hexamethylene diisocyanate, isophorone diisocyanate, and high molecular polyisocyanate), polyol series compounds (e.g., 1,4-butanediol, polyoxypropylene glycol, polyoxyalkylene glycol, and 1,1,1-trimethylolpropane), polyamine series compounds (e.g., ethylenediamine, γ-hydroxypropylated ethylenediamine, phenylenediamine, hexamethylenediamine, N-aminoethylpiperazine, and modified aliphatic polyamines), polyepoxy group-containing compounds and epoxy resins (e.g., the compounds described in Hiroshi Kakiuchi, *Epoxy Resin*, Shokodo (1985), Kuniyuki Hashimoto, *Epoxy Resin*, Nikkan Kogyo Shinbunsha (1969)), melamine resins (e.g., the compounds described in Ichiro Miwa & Hideo Matsunaga, *Urea.Melamine Resins*, Nikkan Kogyo Shinbunsha (1969)), and poly(meth)acrylate series compounds (e.g., the compounds described in Shin Ohgawara, Takeo Saegusa, & Thoshinobu Higashimura, *Oligomer*, Kodansha (1976), Eizo Ohmori, *Kinosei (Functional) Acrylic Resins*, Techno System (1985), specific examples including polyethylene glycol diacrylate, neopentyl glycol diacrylate, 1,6-hexanediol acrylate, trimethylolpropane triacrylate, pentaerythritol polyacrylate, bisphenol A diglycidyl ether acrylate, oligoester acrylate and methacrylate compounds thereof).

The amount of the crosslinking agent used in the present invention is preferably from 0.5 to 30% by weight, and more preferably from 1 to 10% by weight.

In the present invention, if desired, a reaction accelerator may be added to the binder resin for accelerating the crosslinking reaction in the photoconductive layer.

In the case of the reaction system wherein the crosslinking reaction forms a chemical bond between functional groups, examples of the reaction accelerator are organic acids such as acetic acid, propionic acid, butyric acid, benzenesulfonic acid, or p-toluenesulfonic acid.

When the crosslinking reaction is a polymerizing reaction system, examples of the reaction accelerator are polymerization initiators (e.g., peroxides and azobis series compounds, and preferably azobis series polymerization initiators) and monomers having a polyfuncitonal polymerizable group (e.g., vinyl methacrylate, allyl methacrylate, ethylene glycol acrylate, polyethylene glycol diacrylate, divinylsuccinic acid ester, divinyladipic acid ester, diallylsuccinic acid ester, 2-methylvinyl methacrylate, and divinylbenzene).

When the binder resin used in the present invention contains a photo- and/or heat-curable functional group in the binder resin (A), the coated layer is crosslinked or heat-cured after coating the coating composition for forming the photoconductive layer. For carrying out the crosslinking or heat-curing, for example, the drying condition is adjusted stronger than drying condition for making conventional electrophotographic light-sensitive materials. For example, drying is carried out at a high temperature and/or for a long time, or, preferably after drying the coated layer, the layer is further subjected to a heat treatment. For example, the coated layer is treated at a temperature of from 60° C. to 120° C. for from 5 to 120 minutes. Furthermore, when the above-described reaction accelerator is used, the coated layer can be treated under a milder condition.

The resin (A) according to the present invention may further be formed of other copolymerizable monomers as copolymerizable components in addition to the monomer corresponding to the repeating unit of the general formula (I) (including that of the general formula (IIa) or (IIb)) and the monomer containing the acidic group. Examples of such monomers include, in addition to methacrylic acid esters, acrylic acid esters and crotonic acid esters containing substituents other than those described for the general formula (I), α-olefins, vinyl or allyl esters of alkanoic acids (including, e.g., acetic acid, propionic acid, butyric acid, and valeric acid, as examples of the alkanoic acids), acrylonitrile, methacrylonitrile, vinyl ethers, itaconic acid esters (e.g., dimethyl ester, and diethyl ester), acrylamides, methacrylamides, styrenes (e.g., styrene, vinyltoluene, chlorostyrene, hydroxystyrene, N,N-dimethylaminomethylstyrene, methoxycarbonylstyrene, methanesulfonyloxystyrene, and vinylnaphthalene), and heterocyclic vinyl compounds (e.g., vinylpyrrolidone, vinylpyridine, vinylimidazole, vinylthiophene, vinylimidazoline, vinylpyrazoles, vinyldioxane, vinylquinoline, vinyltetrazole, and vinyloxazine).

The resin (A) according to the present invention, in which the specific acidic group is bonded to only one terminal of the polymer main chain, can easily be prepared by an ion polymerization process, in which a various kind of reagents are reacted at the terminal of a living polymer obtained by conventionally known anion polymerization or cation polymerization; a radical polymerization process, in which radical polymerization is performed in the presence of a polymerization initiator and/or a chain transfer agent which contains the specific acidic group in the molecule thereof; or a process, in which a polymer having a reactive group (for example, an amino group, a halogen atom, an epoxy group, and an acid halide group) at the terminal obtained by the above-described ion polymerization or radical polymerization is subjected to a macromolecular reaction to convert the terminal reactive group into the specific acidic group.

More specifically, reference can be made to, e.g., P. Dreyfuss and R. P. Quirk, *Encycl. Polym. Sci. Eng.*, 7, 551 (1987), Yoshiki Nakajo and Yuya Yamashita, *Senryo to Yakuhin*, 30, 232 (1985), Akira Ueda and Susumu Nagai, *Kagaku to Kogyo*, 60, 57 (1986) and literature references cited therein.

Specific examples of chain transfer agents which can be used include mercapto compounds containing the acidic group or the reactive group capable of being converted into the acidic group (e.g., thioglycolic acid, thiomalic acid, thiosalicyclic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)-carbamoyl]-propionic acid, 3-[N-(2-mercaptoethyl)-amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 1-mercapto-2-propanol, 3-mercapto-2-butanol, mercaptophenol, 2-mercaptoethylamine, 2-mercaptoimidazole, 2-mercapto-3-pyridinol, 4-(2-mercaptoethyloxycarbonyl)phthalic anhydride, 2-mercaptoethylphosphonic acid, and monomethyl 2-mercaptoethylphosphonate), and alkyl iodide compounds containing the acidic group or acidic group-forming reactive group (e.g., iodoacetic acid, iodopropionic acid, 2-iodoethanol, 2-iodoethanesulfonic acid, and 3-iodopropanesulfonic acid). Of these compounds, mercapto compounds are preferred.

Specific examples of the polymerization initiators containing the acidic group or reactive group include 4,4'-azobis(4-cyanovaleric acid), 4,4'-azobis(4-cyanovaleric acid chloride), 2,2'-azobis(2-cyanopropanol), 2,2'-azobis(2-cyanopentanol), 2,2'-azobis[2-methyl-N-(2-hydroxyethyl)propionamide], 2,2'-azobis{2-methyl-N-[1,1-bis(hydroxymethyl)-2-hydroxyethyl]propionamide}, 2,2'-azobis{2-[1-(2-hydroxyethyl)-2-imidazolin-2-yl]propane}, 2,2'-azobis[2-(2-imidazolin-2-yl)-propane], and 2,2'-azobis[2-(4,5,6,7-tetrahydro-1H-1,3-diazepin-2-yl)propane].

The chain transfer agent or polymerization initiator is usually used in an amount of from 0.5 to 15 parts by weight, preferably from 2 to 10 parts by weight, per 100 parts by weight of the total monomers.

Now, the resin (B) which can be used in the present invention will be described in greater detail with reference to preferred embodiments below.

The monofunctional macromonomer (M) which can be employed in the resin (B) according to the present invention is described in greater detail below.

The acidic group contained in a component which constitutes the A block of the macromonomer (M) includes $$-PO_3H_2,\ -COOH,\ -SO_3H,\ -OH,\ -\overset{\overset{\displaystyle O}{\|}}{\underset{\underset{\displaystyle R_0}{|}}{P}}-OH$$

($R_0$ represents a hydrocarbon group or $-OR_0'$ (wherein $R_0'$ represents a hydrocarbon group)), and a cyclic acid anhydride-containing group, and the preferred acidic groups are $$-COOH,\ -SO_3H,\ -OH,\ \text{and}\ -\overset{\overset{\displaystyle O}{\|}}{\underset{\underset{\displaystyle R_0}{|}}{P}}-OH.$$

The $$-\overset{\overset{\displaystyle O}{\|}}{\underset{\underset{\displaystyle R_0}{|}}{P}}-OH$$

group and cyclic acid anhydride-containing group each has the same meaning as defined in the resin (A) above.

Further, specific examples of the polymer components containing the specific acidic group for the resin (B) include those described for the resin (A) above.

The —OH group containing polymerizable component includes a hydroxy group of alcohols containing a vinyl group or an allyl group (e.g., allyl alcohol), a hydroxy group of (meth)acrylates containing —OH group in an ester substituent thereof, a hydroxy group of (meth)acrylamides containing —OH group in an N-substituent thereof, a hydroxy group of hydroxy-substituted aromatic compounds containing a polymerizable double bond, and a hydroxy group of (meth)acrylic acid esters and amides each having a hydroxyphenyl group as a substituent.

Two or more kinds of the above-described polymerizable components each containing the specific acidic group can be used in forming in the A block. In such a case, two or more kinds of these acidic group-containing polymerizable components may form a random copolymer or a block copolymer.

Also, other components having no acidic group may be contained in the A block, and examples of such components include the components represented by the genaral formula (III) described in detail below. The content of the component having no acidic group in the A block is preferably from 0 to 50% by weight, and more preferably from 0 to 20% by weight. It is most preferred that such a component is not contained in the A block.

Now, the polymer component constituting the B block in the monofunctional macromonomer of the graft type copolymer (resin (B)) used in the present invention will be explained in more detail below.

The components constituting the B block in the present invention include at least a repeating unit represented by the general formula (III) described above.

In the general formula (III), $X_1$ represents —COO—, —OCO—, $-(CH_2)_{l_1}OCO-$, $-(CH_2)_{l_2}COO-$ (wherein $l_1$ and $l_2$ each represents an integer of from 1 to 3), $$-O-,\ -SO_2-,\ -CO-,\ -\overset{\overset{\displaystyle R_{23}}{|}}{C}ON-,\ -SO_2\overset{\overset{\displaystyle R_{23}}{|}}{N}-,$$

$$-CONHCOO-,\ -CONHCONH-,\ \text{or}\ -$$

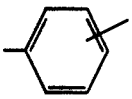

(wherein $R_{23}$ represents a hydrogen atom or a hydrocarbon group).

Preferred examples of the hydrocarbon group represented by $R_{23}$ include an alkyl group having from 1 to 18 carbon atoms which may be substituted (e.g., methyl, ethyl, propyl, butyl, pentyl, hexyl, heptyl octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

In the general formula (III), $R_{21}$ represents a hydrocarbon group, and preferred examples thereof include those described for $R_{23}$. When $X_1$ represents

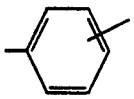

in the general formula (III), $R_{21}$ represents a hydrogen atom or a hydrocarbon group.

When $X_1$ represents

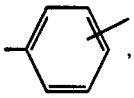

the benzene ring may be substituted. Suitable examples of the substituents include a halogen atom (e.g., chlorine, and bromine), an alkyl group (e.g., methyl, ethyl, propyl, butyl, chloromethyl, and methoxymethyl), and an alkoxy group (e.g., methoxy, ethoxy, propoxy, and butoxy).

In the general formula (III), $c_1$ and $c_2$, which may be the same or different, each preferably represents a hydrogen atom, a halogen atom (e.g., chlorine, and bromine), a cyano group, an alkyl group having from 1 to 4 carbon atoms (e.g., methyl, ethyl, propyl, and butyl), —COO—$R_{24}$ or —COO—$R_{24}$ bonded via a hydrocarbon group, wherein $R_{24}$ represents a hydrocarbon group (preferably an alkyl group having 1 to 18 carbon atoms, an alkenyl group having 4 to 18 carbon atoms, an aralkyl group having 7 to 12 carbon atoms, an alicyclic group having 5 to 8 carbon atoms or an aryl group having 6 to 12 carbon atoms, each of which may be substituted). More specifically, the examples of the hydrocarbon groups are those described for $R_{23}$ above. The hydrocarbon group via which —COO—$R_{24}$ is bonded includes, for example, a methylene group, an ethylene group, an a propylene group.

More preferably, in the general formula (III), $X_1$ represents —COO—, —OCO—, —$CH_2$OCO—, —$CH_2$COO—, —O—, —CONH—, —$SO_2$HN— or

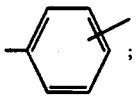

and $c_1$ and $c_2$, which may be the same or different, each represents a hydrogen atom, a methyl group, —$COOR_{24}$, or —$CH_2COOR_{24}$, wherein $R_{24}$ represents an alkyl group having from 1 to 6 carbon atoms (e.g., methyl, ethyl, propyl, butyl, and hexyl). Most preferably, either one of $c_1$ and $c_2$ represents a hydrogen atom.

The B block which is constituted separately from the A block which is composed of the polymer component containing the above-described specific acidic group may contain two or more kinds of the repeating units represented by the general formula (III) described above and may further contain polymer components other than these repeating units. When the B block having no acidic group contains two or more kinds of the polymer components, the polymer components may be contained in the B block in the form of a random copolymer or a block copolymer, but are preferably contained at random therein.

As the polymer component other than the repeating units represented by the general formula (III) which is contained in the B block together with the polymer component(s) selected from the repeating units of the general formula (III), any components copolymerizable with the repeating units of the general formula (III) in forming the B block can be used.

Suitable examples of monomers copolymerizable with the polymerizable component corresponding to the repeating unit represented by the general formula (III), as a polymerizable component for forming the B block include acrylonitrile, methacrylonitrile and heterocyclic vinyl compounds (e.g., vinylpyridine, vinylimidazole, vinylpyrrolidone, vinylthiophene, vinylpyrazole, vinyldioxane, and vinyloxazine). Such other monomers are employed in a range of not more than 20 parts by weight per 100 parts by weight of the total polymer components in the B block.

Further, it is preferred that the B block does not contain the polymer component containing an acidic group which is a component constituting the A block.

As described above, the macromonomer (M) to be used in the present invention has a structure of the AB block copolymer in which a polymerizable double bond group is bonded to one of the terminals of the B block composed of the polymer component represented by the general formula (III) and the other terminal thereof is connected to the A block composed of the polymer component containing the acidic group. The polymerizable double bond group will be described in detail below.

Suitable examples of the polymerizable double bond group include those represented by the following general formula (V):

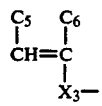

(V)

wherein $X_3$ has the same meaning as $X_1$ defined in the general formula (III), and $c_5$ and $c_6$, which may be the same or different, each has the same meaning as $c_1$ and $c_2$ defined in the general formula (III).

Specific examples of the polymerizable double bond group represented by the general formula (V) include

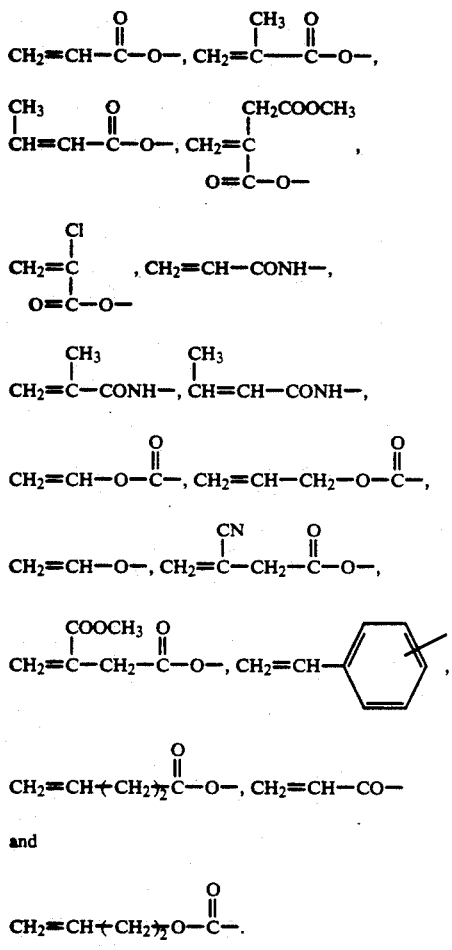

The macromonomer (M) used in the present invention has a structure in which a polymerizable double bond group preferably represented by the general formula (V) is bonded to one of the terminals of the B block either directly or through an appropriate linking group.

The linking group which can be used includes a carbon-carbon bond (either single bond or double bond), a carbon-hetero atom bond (the hetero atom includes, for example, an oxygen atom, a sulfur atom, a nitrogen atom, and a silicon atom), a hetero atom-hetero atom bond, and an appropriate combination thereof.

More specifically, the bond between the group of the general formula (V) and the terminal of the B block is a mere bond or a linking group selected from

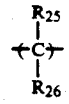

(wherein $R_{25}$ and $R_{26}$ each represents a hydrogen atom, a halogen atom (e.g., fluorine, chlorine, and bromine), a cyano group, a hydroxyl group, or an alkyl group (e.g., methyl, ethyl, and propyl)),

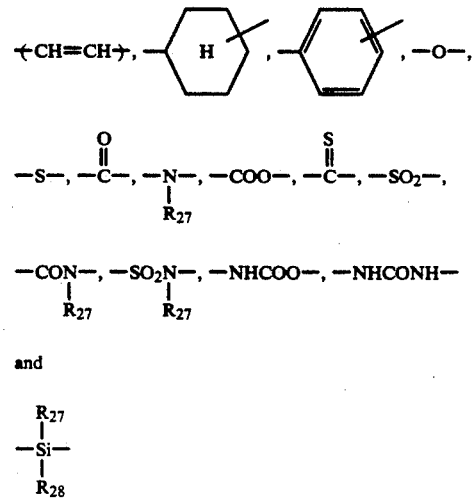

(wherein $R_{27}$ and $R_{28}$ each represents a hydrogen atom or a hydrocarbon group having the same meaning as defined for $R_{21}$ in the general formula (III) described above), and an appropriate combination thereof.

If the weight average molecular weight of the macromonomer (M) exceeds $2\times10^4$, copolymerizability with other monomers is undesirably reduced. If, on the other hand, it is too small, the effect of improving electrophotographic characteristics of the light-sensitive layer would be small. Accordingly, the macromonomer (M) preferably has a weight average molecular weight of at least $1\times10^3$.

The macromonomer (M) used in the present invention can be produced by a conventionally known synthesis method. More specifically, it can be produced by a method comprising previously protecting the acidic group of a monomer corresponding to the polymer component having the specific acidic group to form a functional group, synthesizing an AB block copolymer by a so-called known living polymerization reaction, for example, an ion polymerization reaction with an organic metal compound (e.g., alkyl lithiums, lithium diisopropylamide, and alkylmagnesium halides) or a hydrogen iodide/iodine system, a photopolymerization reaction using a porphyrin metal complex as a catalyst, or a group transfer polymerization reaction, introducing a polymerizable double bond group into the terminal of the resulting living polymer by a reaction with a various kind of reagents, and then conducting a protection-removing reaction of the functional group which has been formed by protecting the acidic group by a hydrolysis reaction, a hydrogenolysis reaction, an oxidative decomposition reaction, or a photodecomposition reaction to form the acidic group.

An example thereof is shown by the following reaction scheme (1):

Reaction Scheme (1)

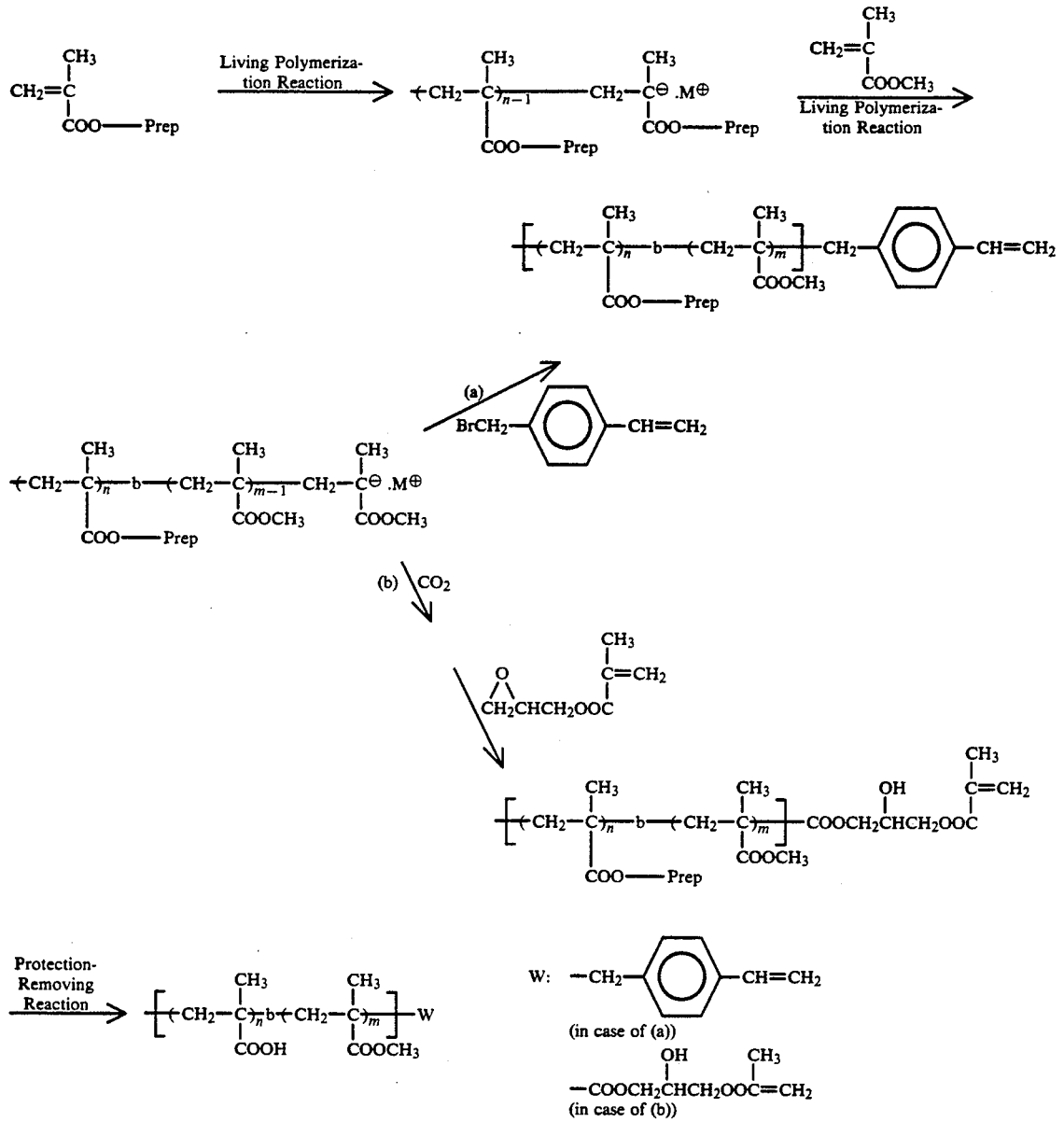

Prep : Protective group for —COOH,

—b— : "—b—" represents that each of the repeating units bonded to —b— is present in the form of a block polymer component (hereinafter the same), n, m : repeating unit The living polymer can be easily synthesized according to synthesis methods as described, e.g., in P. Lutz, P. Masson et al, *Polym. Bull.*, 12, 79 (1984), B. C. Anderson, G. D. Andrews et al, *Macromolecules*, 14, 1601 (1981), K. Hatada, K. Ute et al, *Polym. J.*, 17, 977 (1985), ibid., 18, 1037 (1986), Koichi Migite and Koichi Hatada, *Kobunshi Kako* (*Polymer Processing*), 36, 366 (1987), Toshinobu Higashimura and Mitsuo Sawamoto, *Kobunshi Ronbun Shu* (*Polymer Treatises*), 46, 189 (1989), M. Kuroki and T. Aida, *J. Am. Chem. Soc.*, 109, 4737 (1987), Teizo Aida and Shohei Inoue, *Yuki Gosei Kagaku* (*Organic Synthesis Chemistry*), 43, 300 (1985), and D. Y. Sogoh, W. R. Hertler et al, *Macromolecules*, 20, 1473 (1987).

In order to introduce a polymerizable double bond group into the terminal of the living polymer, a conventionally known synthesis method for macromonomer can be employed.

For details, reference can be made, for example, to P. Dreyfuss and R. P. Quirk, *Encycl. Polym. Sci. Eng.*, 7, 551 (1987), P. F. Rempp and E. Franta, *Adv. Polym. Sci.*, 58, 1 (1984), V. Percec, *Appl. Polym. Sci.*, 285, 95 (1984), R. Asami and M. Takari, *Makromol. Chem. Suppl.*, 12, 163 (1985), P. Rempp et al., *Makromol. Chem. Suppl.*, 8, 3 (1984), Yushi Kawakami, *Kogaku Kogyo*, 38, 56 (1987), Yuya Yamashita, *Kobunshi*, 31, 988 (1982), Shiro Kobayashi, *Kobunshi*, 30, 625 (1981), Toshinobu Higashimura, *Nippon Secchaku Kyokaishi*, 18, 536 (1982), Koichi Itoh, *Kobunshi Kako*, 35, 262 (1986). Kishiro Higashi and Takashi Tsuda, *Kino Zairyo*, 1987, No. 10, 5, and references cited in these literatures.

Also, the protection of the specific acidic group of the present invention and the release of the protective group (a reaction for removing a protective group) can be easily conducted by utilizing conventionally known techniques. More specifically, they can be performed by appropriately selecting methods as described, e.g., in Yoshio Iwakura and Keisuke Kurita, *Hannosei Kobunshi* (*Reactive Polymer*), published by Kodansha (1977), T. W. Greene, *Protective Groups in Organic Synthesis*, published by John Wiley & Sons (1981), and J. F. W. McOmie, *Protective Groups in Organic Chemistry*, Plenum Press, (1973), as well as methods as described in the above references.

Furthermore, the AB block copolymer can also be synthesized by a photoinifeter polymerization method using a dithiocarbamate compound as an initiator. For example, the block copolymer can be synthesized according to synthesis methods as described, e.g., in Takayuki Otsu, *Kobunshi* (*Polymer*), 37, 248 (1988), Shunichi Himori and Ryuichi Ohtsu, *Polym. Rep. Jap.* 37, 3508 (1988), JP-A-64-111, and JP-A-64-26619.

The macromonomer (M) according to the present invention can be obtained by applying the above described synthesis method for macromonomer to the AB block copolymer.

Specific examples of the macromonomer (M) which can be used in the present invention are set forth below, but the present invention should not be construed as being limited thereto. In the following formulae, $Q_1$, $Q_2$ and $Q_3$ each represents —H, —$CH_3$ or —$CH_2COOCH_3$; $Q_4$ represents —H or —$CH_3$; $R_{31}$ represents —$C_nH_{2n+1}$ (wherein n represents an integer of from 1 to 18),

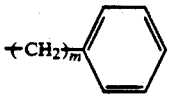

(wherein m represents an integer of from 1 to 3),

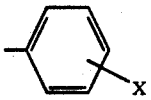

(wherein X represents

—H, —Cl, —Br, —$CH_3$, —$OCH_3$ or —$COCH_3$)

or

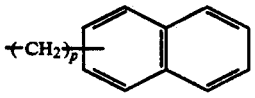

(wherein p represents an integer of from 0 to 3); $R_{32}$ represents —$C_qH_{2q+1}$ (wherein q represents an integer of from 1 to 8) or

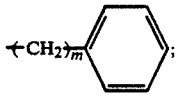

$Y_1$ represents

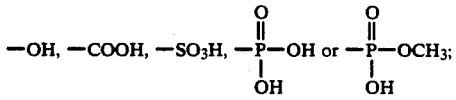

$Y_2$ represents

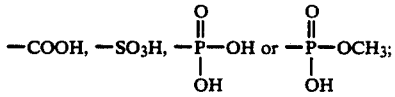

r represents an integer of from 2 to 12; s represents an integer of from 2 to 6; and —b— is as defined above.

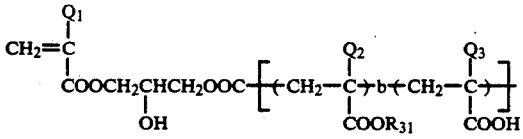

(M-1)

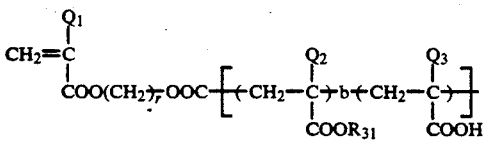

(M-2)

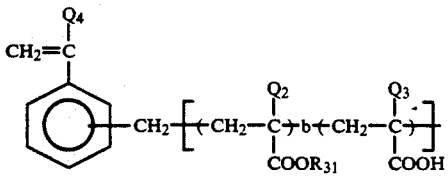

(M-3)

-continued
(M-4)
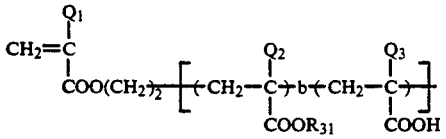
(M-5)
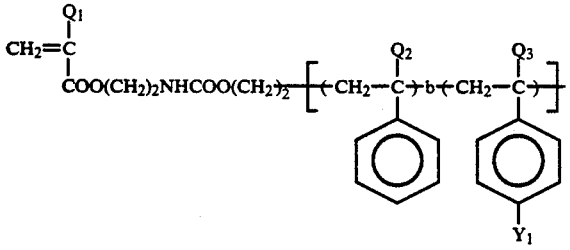
(M-6)
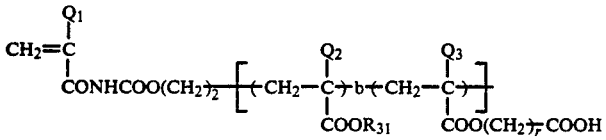
(M-7)
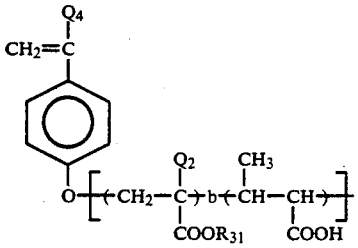
(M-8)
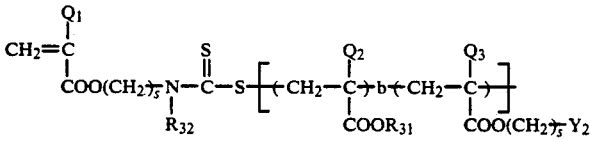
(M-9)
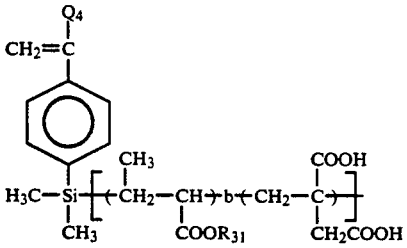
(M-10)
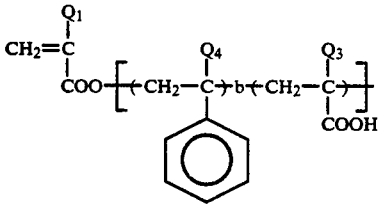
(M-11)
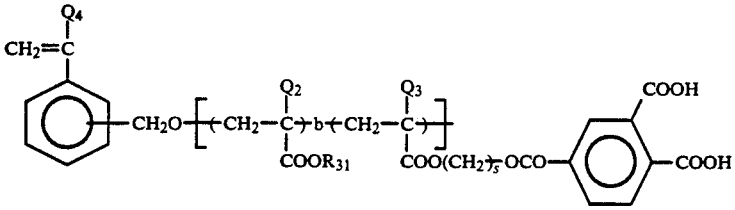

-continued (M-12)

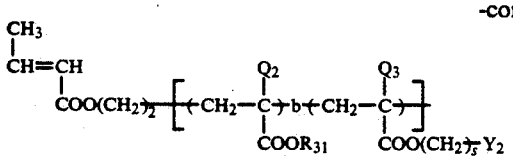

(M-13)

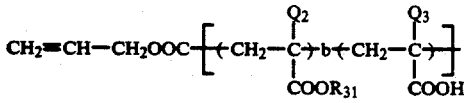

(M-14)

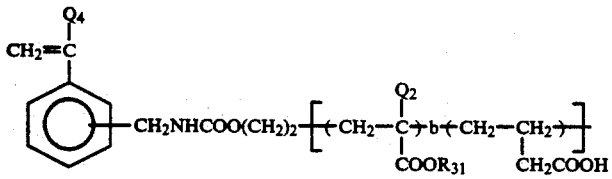

(M-15)

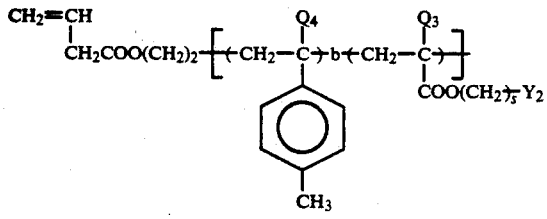

(M-16)

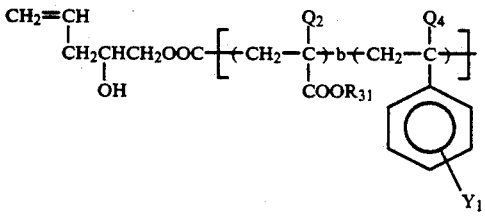

The monomer copolymerizable with the macromonomer (M) described above is preferably selected from those corresponding to the polymer component represented by the general formula (IV) described hereinbefore. In the general formula (IV), $c_3$, $c_4$, $X_2$ and $R_{22}$ each has the same meaning as defined for $c_1$, $c_2$, $X_1$ and $R_{21}$ in the general formula (III) as described above. More preferably, $c_3$ represents a hydrogen atom, $c_4$ represents a methyl group, and $X_2$ represents —COO—.

In the resin (B) used in the present invention, a ratio of the A block to the B block in the macromonomer (M) preferably ranges 1 to 30/99 to 70 by weight. The content of the acidic group-containing component in the resin (B) is preferably from 0.1 to 20% by weight, more preferably from 0.5 to 10% by weight. A ratio of the copolymer component of the macromonomer (M) as a repeating unit to the copolymer component of the monomer represented by the general formula (IV) as a repeating unit ranges preferably 1 to 60/99 to 40 by weight, more preferably 5 to 50/95 to 50 by weight.

Furthermore, the resin (B) may contain a heat- and-/or photo-curable functional group as described for the resin (A) above in its main chain.

The binder resins (A) and (B) according to the present invention can be produced by copolymerization of the corresponding monofunctional polymerizable compounds in the desired ratio. The copolymerization can be performed using a known polymerization method, for example, solution polymerization, suspension polymerization, precipitation polymerization, and emulsion polymerization. More specifically, according to the solution polymerization monomers are added to a solvent such as benzene or toluene in the desired ratio and polymerized with an azobis compound, a peroxide compound or a radical polymerization initiator to prepare a copolymer solution. The resulting solution is dried or added to a poor solvent whereby the desired copolymer can be obtained. In case of suspension polymerization, monomers are suspended in the presence of a dispersing agent such as polyvinyl alcohol or polyvinyl pyrrolidone and copolymerized with a radical polymerization initiator to obtain the desired copolymer.

In the production of the resin (A) ($Mw=1\times10^3$ to $1\times10^4$) and the resin (B) ($Mw=3\times10^4$ to $1\times10^6$) according to the present invention, the molecular weight thereof can be easily controlled by appropriately selecting a kind of initiator (a half-life thereof being varied depending on temperature), an amount of initiator, a starting temperature of the polymerization, and co-use of chain transfer agent, as conventionally known.

As the binder resin of the photoconductive layer according to the present invention, a resin which is conventionally used as a binder resin for electrophotographic light-sensitive materials can be employed in combination with the above described binder resin according to the present invention. Examples of such resins are described, for example, in Harumi Miyamoto and Hidehiko Takei, *Imaging*, Nos. 8 and 9 to 12, 1978 and Ryuji Kurita and Jiro Ishiwata, *Kobunshi* (*Polymer*), 17, 278–284 (1968).

Specific examples thereof include an olefin polymer, an olefin copolymer, a vinyl chloride copolymer, a vinylidene chloride copolymer, a vinyl alkanoate polymer, a vinyl alkanoate copolymer, an allyl alkanoate polymer, an allyl alkanoate copolymer, a styrene and styrene derivative polymer, a styrene and styrene derivative copolymer, a butadiene-styrene copolymer, an isoprene-styrene copolymer, a butadiene-unsaturated carboxylic acid ester copolymer, an acrylonitrile copolymer, a methacrylonitrile copolymer, an alkyl vinyl ether copolymer, acrylic acid ester polymer and copolymer, a methacrylic acid ester polymer and copolymer, a styrene-acrylic acid ester copolymer, a styrene-methacrylic acid ester copolymer, itaconic acid diester polymer and copolymer, a maleic anhydride copolymer, an acrylamide copolymer, a methacrylamide copolymer, a hydroxy group-modified silicone resin, a polycarbonate resin, a ketone resin, an amide resin, a hydroxy group- and carboxy group-modified polyester resin, a butyral resin, a polyvinyl acetal resin, a cyclized rubber-methacrylic acid ester copolymer, a cyclized rubber-acrylic acid ester copolymer, a copolymer having a heterocyclic group containing no nitrogen atom (examples of the heterocyclic ring are a furan ring, a tetrahydrofuran ring, a thiophene ring, a dioxane ring, a dioxolan ring, a lactone ring, a benzofuran ring, a benzothiophene ring, and a 1,3-dioxetane ring), and an epoxy resin.

However, it is preferred that such resins are employed in a range of not more than 30% by weight based on the whole binder resin.

The ratio of the resin (A) to the resin (B) is not particularly restricted, but ranges preferably 5 to 50/95 to 50 by weight, more preferably 10 to 40/90 to 60 by weight.

The inorganic photoconductive substance which can be used in the present invention includes zinc oxide, titanium oxide, zinc sulfide, cadmium sulfide, cadmium carbonate, zinc selenide, cadmium selenide, tellurium selenide, and lead sulfide, preferably zinc oxide.

The binder resin is used in a total amount of from 10 to 100 parts by weight, preferably from 15 to 50 parts by weight, per 100 parts by weight of the inorganic photoconductive substance.

The spectral sensitizer used in the present invention can be any dye capable of spectrally sensitizing in the visible to infrared resin. Examples of the spectral sensitizers include carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), and phthalocyanine dyes (including metallized dyes). Reference can be made to, for example, in Harumi Miyamoto and Hidehiko Takei, *Imaging*, 1973, No. 8, 12, C. J. Young et al., *RCA Review*, 15, 469 (1954), Kohei Kiyota et al., *Denkitsushin Gakkai Ronbunshi*, J 63-C, No. 2, 97 (1980), Yuji Harasaki et al., *Kogyo Kagaku Zasshi*, 66, 78 and 188 (1963), and Tadaaki Tani, *Nihon Shashin Gakkaishi*, 35, 208 (1972).

Specific examples of the carbonium dyes, triphenylmethane dyes, xanthene dyes, and phthalein dyes are described, for example, in JP-B-51-452, JP-A-50-90334, JP-A-50-114227, JP-A-53-39130, JP-A-53-82353, U.S. Pat. Nos. 3,052,540 and 4,054,450, and JP-A-57-16456.

The polymethine dyes, such as oxonol dyes, merocyanine dyes, cyanine dyes, and rhodacyanine dyes, include those described, for example, in F. M. Hamer, *The Cyanine Dyes and Related Compounds*. Specific examples include those described, for example, in U.S. Pat. Nos. 3,047,384, 3,110,591, 3,121,008, 3,125,447, 3,128,179, 3,132,942, and 3,622,317, British Patents 1,226,892, 1,309,274 and 1,405,898, JP-B-48-7814 and JP-B-55-18892.

In addition, polymethine dyes capable of spectrally sensitizing in the longer wavelength region of 700 nm or more, i.e., from the near infrared region to the infrared region, include those described, for example, in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research disclosure*, 216, 117 to 118 (1982).

The light-sensitive material of the present invention is particularly excellent in that the performance properties are not liable to variation even when combined with various kinds of sensitizing dyes.

If desired, the photoconductive layer may further contain various additives commonly employed in conventional electrophotographic light-sensitive layer, such as chemical sensitizers. Examples of such additives include electron-accepting compounds (e.g., halogen, benzoquinone, chloranil, acid anhydrides, and organic carboxylic acids) as described in the above-mentioned *Imaging*, 1973, No. 8, 12; and polyarylalkane compounds, hindered phenol compounds, and p-phenylenediamine compounds as described in Hiroshi Kokado et al., *Saikin-no Kododen Zairyo to Kankotai no Kaihatsu Jitsuyoka*, Chaps. 4 to 6, Nippon Kagaku Joho K. K. (1986).

The amount of these additives is not particularly restricted and usually ranges from 0.0001 to 2.0 parts by weight per 100 parts by weight of the photoconductive substance.

The photoconductive layer suitably has a thickness of from 1 to 100 μm, preferably from 10 to 50 μm.

In cases where the photoconductive layer functions as a charge generating layer in a laminated light-sensitive material composed of a charge generating layer and a charge transporting layer, the thickness of the charge generating layer suitably ranges from 0.01 to 1 μm, particularly from 0.05 to 0.5 μm.

If desired, an insulating layer can be provided on the light-sensitive layer of the present invention. When the insulating layer is made to serve for the main purposes for protection and improvement of durability and dark decay characteristics of the light-sensitive material, its thickness is relatively small. When the insulating layer is formed to provide the light-sensitive material suitable for application to special electrophotographic processes, its thickness is relatively large, usually ranging from 5 to 70 μm, particularly from 10 to 50 μm.

Charge transporting material in the above-described laminated light-sensitive material include polyvinylcarbazole, oxazole dyes, pyrazoline dyes, and triphenylmethane dyes. The thickness of the charge transporting layer ranges from 5 to 40 μm, preferably from 10 to 30 μm.

Resins to be used in the insulating layer or charge transporting layer typically include thermoplastic and thermosetting resins, e.g., polystyrene resins, polyester resins, cellulose resins, polyether resins, vinyl chloride resins, vinyl acetate resins, vinyl chloride-vinyl acetate copolymer resins, polyacrylate resins, polyolefin resins, urethane resins, epoxy resins, melamine resins, and silicone resins.

The photoconductive layer according to the present invention can be provided on any known support. In general, a support for an electrophotographic light-sensitive layer is preferably electrically conductive. Any of conventionally employed conductive supports may be utilized in the present invention. Examples of usable conductive supports include a substrate (e.g., a metal sheet, paper, and a plastic sheet) having been rendered electrically conductive by, for example, impregnating with a low resistant substance; the above-described substrate with the back side thereof (opposite to the light-sensitive layer side) being rendered conductive and having further coated thereon at least one layer for the purpose of prevention of curling; the above-described substrate having provided thereon a water-resistant adhesive layer; the above-described substrate having provided thereon at least one precoat layer; and paper laminated with a conductive plastic film on which aluminum is vapor deposited.

Specific examples of conductive supports and materials for imparting conductivity are described, for example, in Yukio Sakamoto, *Denshishashin*, 14, No. 1, 2 to 11 (1975), Hiroyuki Moriga, *Nyumon Tokushushi no Kagaku*, Kobunshi Kankokai (1975), and M. F. Hoover, *J, Macromol. Sci. Chem.*, A-4(6), 1327 to 1417 (1970).

In accordance with the present invention, an electrophotographic light-sensitive material which exhibits improved electrostatic charging characteristics and pre-exposure fatigue resistance can be obtained. Also, an electrophotographic lithographic printing plate precursor which provides clear prints of good image quality can be obtained.

Moreover, the electrophotographic characteristics are more improved when the specific methacrylate component represented by the general formula (IIa) or (IIb) is employed as a copolymerizable component in the resin (A).

The present invention will now be illustrated in greater detail with reference to the following examples, but it should be understood that the present invention is not to be construed as being limited thereto.

SYNTHESIS EXAMPLE A-1

Synthesis of Resin (A-1)

A mixed solution of 98 g of benzyl methacrylate, 2 g of acrylic acid, 3 g of thiosalicylic acid, and 200 g of toluene was heated to 70° C. under nitrogen gas stream.

Then, after adding 1.0 g of 2,2'-azobisisobutyronitrile (hereinafter simply referred to as AIBN) to the above mixture, the reaction was carried out for 4 hours. Then, after adding thereto 0.4 g of AIBN, the mixture was stirred for 2 hours and, after further adding thereto 0.2 g of AIBN, the mixture was stirred for 3 hours. The weight average molecular weight (Mw) of the resulting copolymer (A-1) was $6.5\times10^3$.

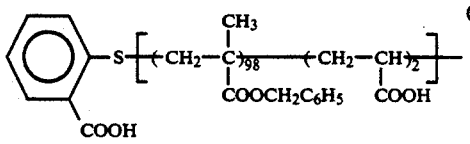

SYNTHESIS EXAMPLES A-2 TO A-16

Synthesis of Resins (A-2) to (A-16)

Each of resins (A) shown in Table 1 was synthesized by following the same procedure as Synthesis Example A-1 except that each of the monomers shown in Table 1 below was used in place of 98 g of benzyl methacrylate and 2 g of acrylic acid. The weight average molecular weight of each of the resins obtained was in a range from $6\times10^3$ to $8\times10^3$.

TABLE 1

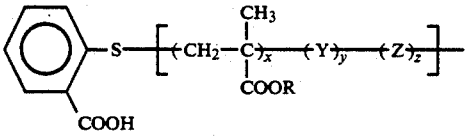

| Synthesis Example No. | Resin (A) | R | —Y— | —Z— | x/y/z (weight ratio) |
|---|---|---|---|---|---|
| 2 | A-2 | $-C_2H_5$ | — | $-CH_2-C(CH_3)(COOH)-$ | 97/0/3.0 |
| 3 | A-3 | $-C_3H_7$ | — | $-CH_2-C(CH_3)(COOH)-$ | 96.5/0/3.5 |
| 4 | A-4 | $-CH_2C_6H_5$ | — | $-CH(CH_3)-CH(COOH)-$ | 98/0/2.0 |
| 5 | A-5 | $-CH_2C_6H_5$ | $-CH_2-CH(COOCH_3)-$ | $-CH_2-C(COOH)(CH_2COOH)-$ | 89/10/1.0 |
| 6 | A-6 | $-CH_3$ | $-CH_2-CH(COOC_2H_5)-$ | $-CH_2-CH(COO(CH_2)_2COOH)-$ | 82/15/3.0 |

TABLE 1-continued
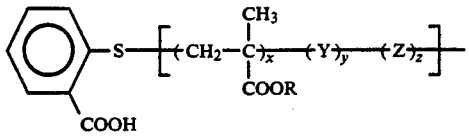
| Synthesis Example No. | Resin (A) | R | —Y— | —Z— | x/y/z (weight ratio) |
|---|---|---|---|---|---|
| 7 | A-7 | $-C_6H_5$ | — | $-CH_2-CH(COOH)-$ | 98.5/0/1.5 |
| 8 | A-8 | 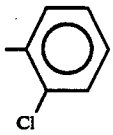 | — | " | 98/0/2.0 |
| 9 | A-9 | 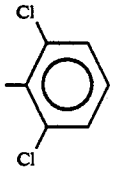 | — | $-CH_2-C(CH_3)(COOH)-$ | 97/0/3.0 |
| 10 | A-10 | 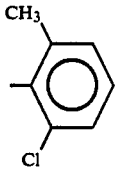 | — | $-CH_2-C(CH_3)(COO(CH_2)_2OCO(CH_2)_2COOH)-$ | 95/0/5.0 |
| 11 | A-11 | 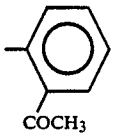 | — | 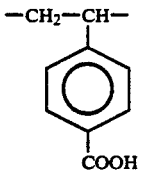 | 96/0/4.0 |
| 12 | A-12 | 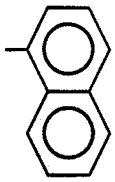 | $-CH_2-CH(COOCH_3)-$ | $-CH_2-CH(COOH)-$ | 82.5/15/2.5 |
| 13 | A-13 | 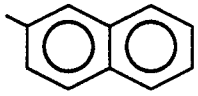 | — | $-CH_2-C(CH_3)(COO(CH_2)_2O-P(=O)(OH)-OH)-$ | 99/0/1.0 |
| 14 | A-14 | $-CH_2-$ 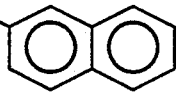 | — | $-CH_2-C(CH_3)(COO(CH_2)_2SO_3H)-$ | 99.2/0/0.8 |
| 15 | A-15 | $-CH_2C_6H_5$ | — | 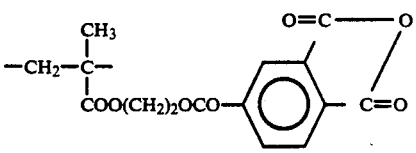 | 94/0/6.0 |

TABLE 1-continued

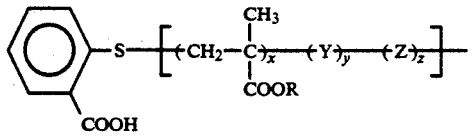

| Synthesis Example No. | Resin (A) | R | —Y— | —Z— | x/y/z (weight ratio) |
|---|---|---|---|---|---|
| 16 | A-16 | $-C_4H_9$ | $-CH_2-CH(CN)-$ | $-CH_2-C(CH_3)(COO(CH_2)_2COOH)-$ | 92/5/3.0 |

SYNTHESIS EXAMPLES A-17 TO A-27

Synthesis of Resins (A-17) to (A-27)

Each of resins (A) shown in Table 2 was synthesized by following the same procedure as Synthesis Example A-1 except that each of the methacrylates and each of the mercapto compounds shown in Table 2 below were used in place of 98 g of benzyl methacrylate and 3 g of thiosalicylic acid, and that 150 g of toluene and 50 g of isopropanol were used in place of 200 g of toluene.

TABLE 2

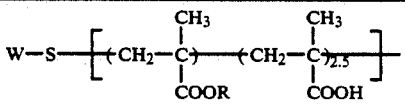

| Synthesis Example No. | Resin (A) | Mercapto Compound (W—) | | R— | | Weight Average Molecular Weight |
|---|---|---|---|---|---|---|
| 17 | A-17 | $HOOCCH_2CH_2CH_2-$ | 4 g | $-C_2H_5$ | 96 g | $7.3 \times 10^3$ |
| 18 | A-18 | $HOOCCH_2-$ | 5 g | $-C_3H_7$ | 95 g | $5.8 \times 10^3$ |
| 19 | A-19 | $HOOC-CH(HOOC-CH_2)-$ | 5 g | $-CH_2C_6H_5$ | 95 g | $7.5 \times 10^3$ |
| 20 | A-20 | $HOOCCH_2CH_2-$ | 5.5 g | $-C_6H_5$ | 94.5 g | $6.5 \times 10^3$ |
| 21 | A-21 | $HOOCCH_2-$ | 4 g | 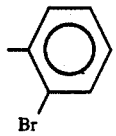 | 96 g | $5.3 \times 10^3$ |
| 22 | A-22 | $HO-P(=O)(OH)-OCH_2CH_2-$ | 3 g | 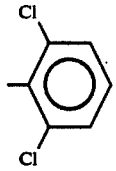 | 97 g | $6.0 \times 10^3$ |
| 23 | A-23 | $HO_3SCH_2CH_2-$ | 3 g | 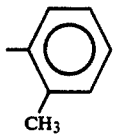 | 97 g | $8.8 \times 10^3$ |
| 24 | A-24 | $H_2C_2O-P(=O)(OH)-OCH_2CH_2-$ | 4 g | 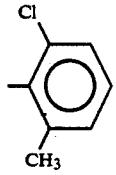 | 96 g | $7.5 \times 10^3$ |

TABLE 2-continued

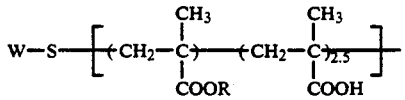

| Synthesis Example No. | Resin (A) | Mercapto Compound (W—) | | R— | | Weight Average Molecular Weight |
|---|---|---|---|---|---|---|
| 25 | A-25 | 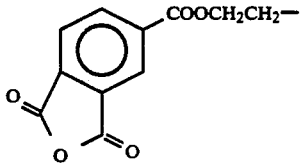 | 7 g | 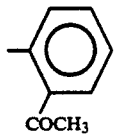 | 93 g | $5.5 \times 10^3$ |
| 26 | A-26 | 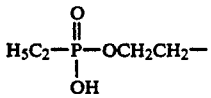 | 6 g | 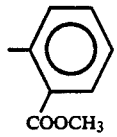 | 94 g | $4.5 \times 10^3$ |
| 27 | A-27 | 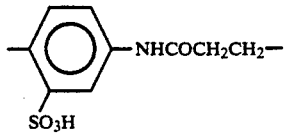 | 4 g | 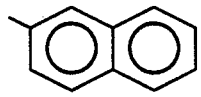 | 96 g | $5.6 \times 10^3$ |

SYNTHESIS EXAMPLE A-28

Synthesis of Resin (A-28)

A mixed solution of 97 g of 1-naphthyl methacrylate, 3 g of methacrylic acid, 150 g of toluene, and 50 g of isopropanol was heated to 80° C. under nitrogen gas stream. After adding 5.0 g of 4,4'-azobis(4-cyanovaleric acid) (hereinafter simply referred to as ACV) to the mixture, the resulting mixture was stirred for 5 hours. Then, after adding thereto 1 g of ACV, the mixture was stirred for 2 hours and, after further adding thereto 1 g of ACV, the mixture was stirred for 3 hours. The weight average molecular weight of the resulting copolymer (A-28) was $7.5 \times 10^3$.

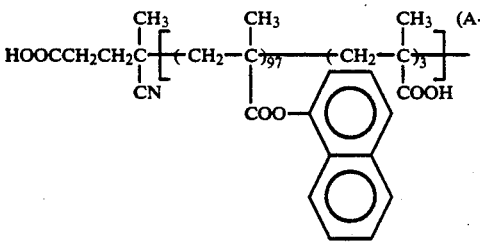

(A-28)

SYNTHESIS EXAMPLE A-29

Synthesis of Resin (A-29)

A mixed solution of 97 g of benzyl methacrylate, 3 g of vinylbenzenecarboxylic acid, 1.5 g of thiosalicyclic acid, and 200 g of toluene was heated to 75° C. under nitrogen gas stream. Then, after adding 3.0 of ACV to the resulting mixture, the reaction was carried out for 6 hours and, after further adding thereto 0.4 g of AIBN, the reaction was carried out for 3 hours. An Mw of the resulting copolymer (A-29) was $5.8 \times 10^3$.

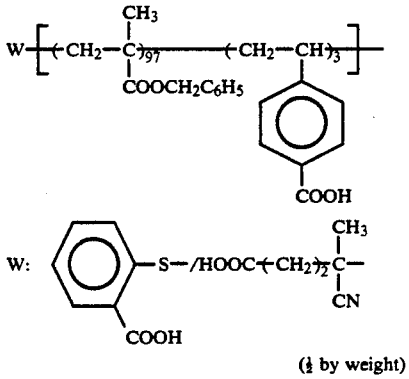

(A-29)

(½ by weight)

SYNTHESIS EXAMPLE M-1

Synthesis of Macromonomer (MM-1)

A mixed solution of 10 g of triphenylmethyl methacrylate, and 100 g of toluene was sufficiently degassed under nitrogen gas stream and cooled to −20° C. Then, 0.02 g of 1,1-diphenylbutyl lithium was added to the mixture, and the reaction was conducted for 10 hours. Separately, a mixed solution of 90 g of ethyl methacrylate and 100 g of toluene was sufficiently degassed under nitrogen gas stream and the resulting mixed solution was added to the above described mixture, and then reaction was further conducted for 10 hours. The reaction mixture was adjusted to 0° C., and carbon dioxide gas was passed through the mixture in a flow rate of 60 ml/min for 30 minutes, then the polymerization reaction was terminated.

The temperature of the reaction solution obtained was raised to 25° C. under stirring, 6 g of 2-hydroxyethyl methacrylate was added thereto, then a mixed solution of 10 g of dicyclohexylcarbodiimide, 0.2 g of 4-N,N-dimethylaminopyridine and 30 g of methylene chloride was added dropwise thereto over a period of 30 minutes, and the mixture was stirred for 3 hours.

After removing the insoluble substances deposited from the reaction mixture by filtration, 10 ml of an ethanol solution of 30% by weight hydrogen chloride was added to the filtrate and the mixture was stirred for one hour. Then, the solvent of the reaction mixture was distilled off under reduced pressure until the whole volume was reduced to a half, and the mixture was reprecipitated from one liter of petroleum ether.

The precipitates thus formed were collected and dried under reduced pressure to obtain 56 g of Macromonomer (MM-1) shown below having an Mw of $6.5\times10^3$.

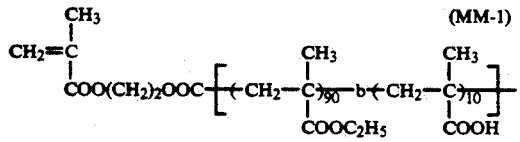

SYNTHESIS EXAMPLE M-2

Synthesis of Macromonomer (MM-2)

A mixed solution of 5 g of benzyl methacrylate, 0.01 g of (tetraphenyl porphinate) aluminum methyl, and 60 g of methylene chloride was raised to a temperature of 30° C. under nitrogen gas stream. The mixture was irradiated with light from a xenon lamp of 300 W at a distance of 25 cm through a glass filter, and the reaction was conducted for 12 hours. To the mixture was further added 45 g of butyl methacrylate, after similarly light-irradiating for 8 hours, 5 g of 4-bromomethylstyrene was added to the reaction mixture followed by stirring for 30 minutes, then the reaction was terminated. Then, Pd-C was added to the reaction mixture, and a catalytic reduction reaction was conducted for one hour at 25° C.

After removing the insoluble substances from the reaction mixture by filtration, the reaction mixture was reprecipitated from 500 ml of petroleum ether and the precipitates thus formed were collected and dried to obtain 33 g of Macromonomer (MM-2) shown below having an Mw of $7\times10^3$.

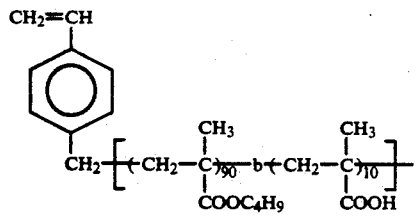

SYNTHESIS EXAMPLE M-3

Synthesis of Macromonomer (MM-3)

A mixed solution of 20 g of 4-vinylphenyloxytrimethylsilane and 100 g of toluene was sufficiently degassed under nitrogen gas stream and cooled to 0° C. Then, 0.1 g of 1,1-diphenyl-3-methylpentyl lithium was added to the mixture followed by stirring for 6 hours. Separately, a mixed solution of 80 g of 2-chloro-6-methylphenyl methacrylate and 100 g of toluene was sufficiently degassed under nitrogen gas stream and the resulting mixed solution was added to the above described mixture, and then reaction was further conducted for 8 hours. After introducing ethylene oxide in a flow rate of 30 ml/min into the reaction mixture for 30 minutes with vigorously stirring, the mixture was cooled to a temperature of 15° C., and 8 g of methacrylic chloride was added dropwise thereto over a period of 30 minutes, followed by stirring for 3 hours.

Then, to the reaction mixture was added 10 ml of an ethanol solution of 30% by weight hydrogen chloride and, after stirring the mixture for one hour at 25° C., the mixture was reprecipitated from one liter of petroleum ether. The precipitates thus formed were collected, washed twice with 300 ml of diethyl ether and dried to obtain 55 g of Macromonomer (MM-3) shown below having an Mw of $7.8\times10^3$.

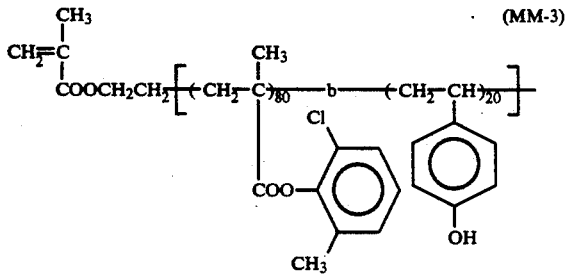

SYNTHESIS EXAMPLE M-4

Synthesis of Macromonomer (MM-4)

A mixed solution of 15 g of triphenylmethyl acrylate and 100 g of toluene was sufficiently degassed under nitrogen gas stream and cooled to −20° C. Then, 0.1 g of sec-butyl lithium was added to the mixture, and the reaction was conducted for 10 hours. Separately, a mixed solution of 85 g of styrene and 100 g of toluene was sufficiently degassed under nitrogen gas stream and the resulting mixed solution was added to the above described mixture, and then reaction was further conducted for 12 hours. The reaction mixture was adjusted to 0° C., 8 g of benzyl bromide was added thereto, and the reaction was conducted for one hour, followed by reacting at 25° C. for 2 hours.

Then, to the reaction mixture was added 10 ml of an ethanol solution of 30% by weight hydrogen chloride, followed by stirring for 2 hours. After removing the insoluble substances from the reaction mixture by filtration, the mixture was reprecipitated from one liter of n-hexane. The precipitates thus formed were collected and dried under reduced pressure to obtain 58 g of Macromonomer (MM-4) shown below having an Mw of $4.5\times10^3$.

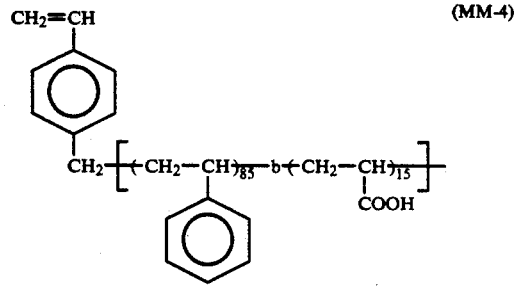

SYNTHESIS EXAMPLE M-5

Synthesis of Macromonomer (MM-5)

A mixed solution of 80 g of phenyl methacrylate and 4.8 g of benzyl N-hydroxyethyl-N-ethyldithiocarbamate was placed in a vessel under nitrogen gas stream followed by closing the vessel and heated to 60° C. The mixture was irradiated with light from a high-pressure mercury lamp for 400 W at a distance of 10 cm through a glass filter for 10 hours to conduct a photopolymerization.

Then, 20 g of acrylic acid and 180 g of methyl ethyl ketone were added to the mixture and, after replacing the gas in the vessel with nitrogen, the mixture was light-irradiated again for 10 hours.

To the reaction mixture was added dropwise 6 g of 2-isocyanotoethyl methacrylate at 30° C. over a period of one hour and the mixture was stirred for 2 hours. The reaction mixture was reprecipitated from 1.5 liters of hexane and the precipitates thus formed were collected and dried to obtain 68 g of Macromonomer (MM-5) shown below having an Mw of $6.0\times10^3$.

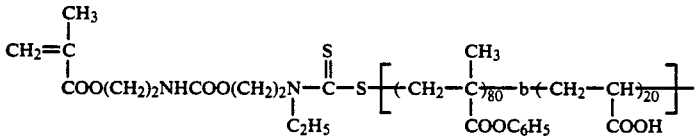

(MM-5)

SYNTHESIS EXAMPLE B-1

Synthesis of Resin (B-1)

A mixed solution of 80 g of ethyl methacrylate, 20 g of Macromonomer (MM-1) and 150 g of toluene was heated at 85° C. under nitrogen gas stream, and 0.8 g of 1,1-azobis(cycohexane-1-carbonitrile) (hereinafter simply referred to as ABCC) to effect reaction for 5 hours. Then, 0.5 g of ABCC was further added thereto, followed by reacting for 5 hours. The resulting copolymer shown below had an Mw of $1.0\times10^5$.

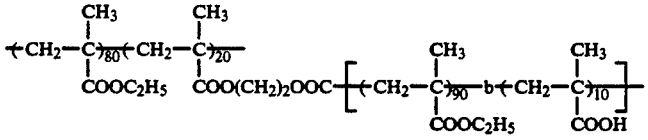

(B-1)

SYNTHESIS EXAMPLE B-2

Synthesis of Resin (B-2)

A mixed solution of 70 g of butyl methacrylate, 30 g of Macromonomer (MM-1), and 150 g of toluene was heated at 70° C. under nitrogen gas stream, and 0.5 g of AIBN was added thereto to effect reaction for 6 hours. Then, 0.3 g of AIBN was further added, followed by reacting for 4 hours and thereafter 0.3 g of AIBN was further added, followed by reacting for 4 hours. The resulting copolymer shown below had an Mw of $8.5\times10^4$.

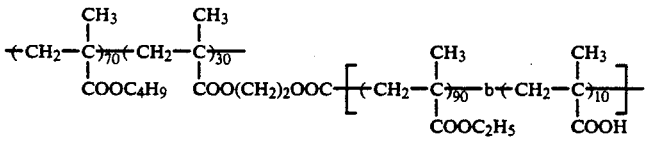

(B-2)

SYNTHESIS EXAMPLES B-3 TO B-9

Synthesis of Resins (B-3) to (B-9)

Resins (B) shown in Table 3 below were synthesized under the same polymerization conditions as described in Synthesis Example B-2. Each of these resins had an Mw of from $7\times10^4$ to $9\times10^4$.

TABLE 3
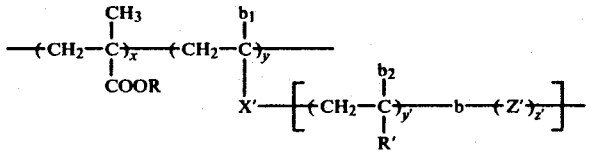
| Synthesis Example No. | Resin (B) | —R | —X'— | x/y | $b_1/b_2$ | —R' | —Z' | y'/z' |
|---|---|---|---|---|---|---|---|---|
| 3 | B-3 | $-CH_3$ | $-COO(CH_2)_2OOC-$ | 90/10 | $-CH_3/-CH_3$ | $-COOC_4H_9$ | $-CH_2-C(CH_3)(COOH)-$ | 90/10 |
| 4 | B-4 | $-C_3H_7(n)$ | 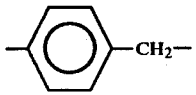 | 80/20 | $-H/-CH_3$ | $-COOC_2H_5$ | 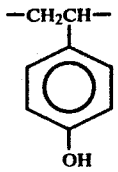 | 80/20 |
| 5 | B-5 | $-CH_2C_6H_5$ | $-COO(CH_2)_2-$ | 90/10 | $-H/-CH_3$ | $-OC_2H_5$ | $-CH_2-C(CH_3)(COO(CH_2)_4SO_3H)-$ | 95/5 |
| 6 | B-6 | $-C_2H_5$ | $-COO-$ | 90/10 | $-CH_3/-CH_3$ | $-COOC_2H_5$ | $-CH_2-CH(COOH)-$ | 90/10 |
| 7 | B-7 | " | $-COO(CH_2)_2NHCOO-$ $(CH_2)_2$ | 90/10 | $-CH_3/-H$ | $-COOC_3H_7$ | 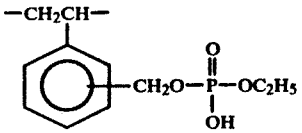 | 85/15 |
| 8 | B-8 | $-CH_2C_6H_5$ | $COO(CH_2)_2N(C_2H_5)-C(=S)-S-$ | 90/10 | $-H/-CH_3$ | $-COOC_2H_5$ | $-CH_2-C(CH_3)(COO(CH_2)_2O-P(=O)(OH)-OH)-$ | 92/8 |

TABLE 3-continued
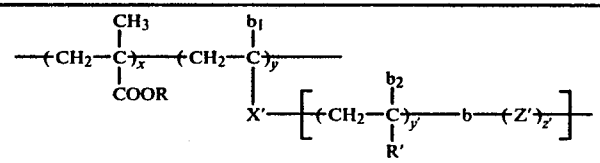
| Synthesis Example No. | Resin (B) | —R | —X'— | x/y | $b_1/b_2$ | —R' | —Z' | y'/z' |
|---|---|---|---|---|---|---|---|---|
| 9 | B-9 | $-C_2H_5$ | —COO— | 85/15 | —H/—H | 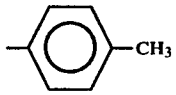 | 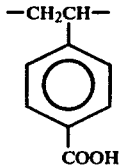 | 90/10 |

SYNTHESIS EXAMPLES B-10 TO B-20

Synthesis of Resins (B-10) to (B-20)

Resins (B) shown in Table 4 below were synthesized under the same polymerization conditions as described in Synthesis Example B-1. Each of these resins had an Mw of from $9\times10^4$ to $2\times10^5$.

TABLE 4

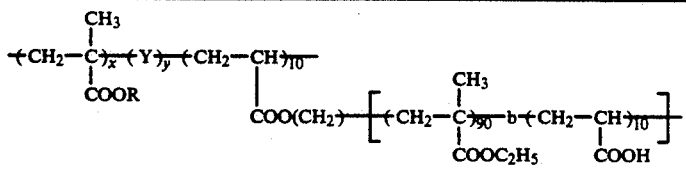

x + y + 10 = 100 (by weight)

| Synthesis Example No. | Resin (B) | —R | —X'— | x/y |
|---|---|---|---|---|
| 10 | B-10 | $-C_2H_5$ | $-CH_2-CH(COOCH_3)-$ | 70/20 |
| 11 | B-11 | $-CH_3$ | $-CH_2-CH(COOC_2H_5)-$ | 75/15 |
| 12 | B-12 | $-C_4H_9$ | $-CH_2-CH(C_6H_5)-$ | 70/20 |
| 13 | B-13 | " | $-CH_2-CH(CN)-$ | 80/10 |
| 14 | B-14 | $-C_4H_9$ | $-CH_2-CH(COO(CH_2)_2CN)-$ | 75/15 |
| 15 | B-15 | $-CH_2C_6H_5$ | $-CH_2-C(CH_3)(COO(CH_2)_2OH)-$ | 80/10 |
| 16 | B-16 | $-C_2H_5$ | $-CH_2-CH(CONH_2)-$ | 85/5 |
| 17 | B-17 | $-C_2H_5$ | $-CH_2-C(CH_3)(COO(CH_2)_2N\langle O\rangle)-$ | 85/5 |
| 18 | B-18 | $-C_2H_5$ | $-CH_2-CH(C_6H_4-CH_3)-$ | 75/15 |
| 19 | B-19 | $-C_6H_4-CH_3$ | $-CH_2-C(CH_3)(COOC_2H_5)-$ | 70/20 |

TABLE 4-continued

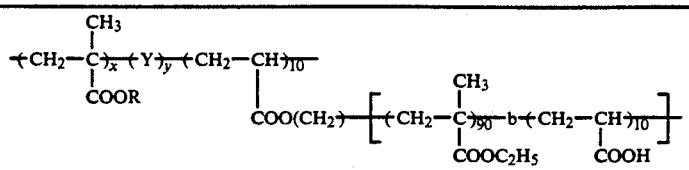

x + y + 10 = 100 (by weight)

| Synthesis Example No. | Resin (B) | —R | —X'— | x/y |
|---|---|---|---|---|
| 20 | B-20 | 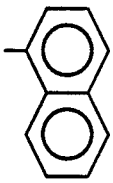 | —CH₂—CH(COOC₂H₅)— | 70/20 |

EXAMPLE 1

A mixture of 6.5 g (solid basis, hereinafter the same) of Resin (A-1), 33.5 g (solid basis, hereinafter the same) of Resin (B-1), 200 g of zinc oxide, 0.018 g of Cyanine Dye (I) shown below, and 300 g of toluene was dispersed by a homogenizer (manufactured by Nippon Seiki K. K.) at $1\times10^4$ r.p.m. for 10 minutes to prepare a coating composition for a light-sensitive layer. The coating composition was coated on paper, which had been subjected to electrically conductive treatment, by a wire bar at a dry coverage of 25 g/m$^2$, followed by drying at 110° C. for 30 seconds. The coated material was allowed to stand in a dark place at 20° C. and 65% RH (relative humidity) for 24 hours to prepare an electrophotographic light-sensitive material.

Cyanine Dye (I):

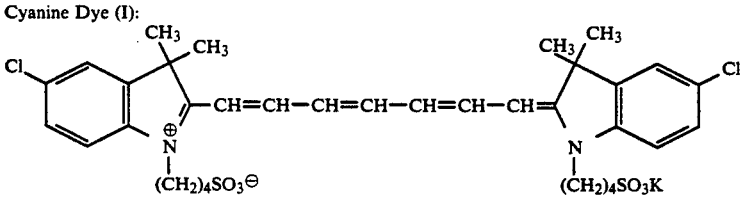

EXAMPLE 2

An electrophotographic light-sensitive material was prepared in the same manner as described in Example 1, except for using 6.5 g of Resin (A-8) in place of 6.5 g of Resin (A-1).

COMPARATIVE EXAMPLE A

An electrophotographic light-sensitive material was prepared in the same manner as described in Example 1 except that 6.5 g of Resin (R-1) for comparison having the following formula was used as a binder resin in place of 6.5 g of Resin (A-1).

Resin (R-1):

-continued

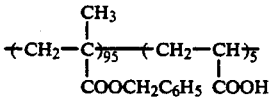

(weight ratio)

Mw: 6.3 × 10$^3$

COMPARATIVE EXAMPLE B

An electrophotographic light-sensitive material was prepared in the same manner as described in Example 1 except that 6.5 g of Resin (R-2) for comparison having the following formula was used as a binder resin in place of 6.5 g of Resin (A-1).

Resin (R-2):

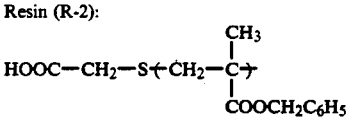

Mw: 6.3 × 10$^3$

COMPARATIVE EXAMPLE C

An electrophotographic light-sensitive material was prepared in the same manner as described in Example 1 except that 40 g of Resin (R-2) described above was used as a binder resin in place of Resin (A-1) and Resin (B-1).

On each of the light-sensitive materials thus prepared, the film property (surface smoothness), the charging property (occurrence of uneven charging), and the pre-exposure fatigue resistance were determined.

Furthermore, the printing property (background stains and printing durability) were determined when each of the light-sensitive materials was used as an offset printing master plate.

The results obtained are shown in Table 5 below.

TABLE 5

| | Example 1 | Example 2 | Comparative Example A | Comparative Example B | Comparative Example C |
|---|---|---|---|---|---|
| Smoothness of Photoconductive Layer*1 (sec/cc) | 580 | 550 | 600 | 590 | 580 |
| Charging Property*2 (Uneven Charging) | Good (none) | Very Good (none) | Poor (uneven charging) | No Good (slight uneven charging) | Poor (uneven charging) |
| Pre-Exposure Fatigue Resistance*3 | | | | | |
| $V_{10}$ Recovery Ratio (%) | 90% | 98% | 68% | 74% | 66% |
| Image-Forming Performance | Good | Very Good | Very Poor (reduced Dmax, background fog, scratches of fine lines) | Poor (reduced Dmax, background fog, scratches of fine lines) | Poor (reduced Dmax, background fog, scratches of fine lines) |
| Printing Property*4 | | | | | |
| Background Stains of Light-Sensitive Material | None | None | None | None | None |
| Printing Durability | 10,000 | 10,000 | Background stains from the start of printing | Background stains from the start of printing | Background stains from the start of printing |

The evaluations described in Table 5 above were conducted as follows.

*1) Smoothness of Photoconductive Layer:

The smoothness (sec/cc) of the light-sensitive material was measured using a Beck's smoothness test machine (manufactured by Kumagaya Riko K. K.) under an air volume condition of 1 cc.

*2) Charging Property:

The light-sensitive material was allowed to stand one day under the condition of 20° C. and 65% RH. Then, after modifying parameters of a full-automatic plate making machine (ELP-404V, manufactured by Fuji Photo Film Co., Ltd.) to the forced conditions of a charging potential of −4.5 kV and a charging speed of 20 cm/sec, the light-sensitive material was treated with the machine using a solid black image as an original and a toner (ELP-T, manufactured by Fuji Photo Film Co., Ltd.). The solid black image thus obtained was visually evaluated with respect to the presence of unevenness of charging and density in the solid black portion.

*3) Pre-Exposure Fatigue Resistance:

$V_{10}$ Recovery Ratio:

After applying a corona discharge to the light-sensitive material in a dark place at 20° C. and 65% RH using a paper analyzer (Paper Analyzer Type SP-428, manufactured by Kawaguchi Denki K. K.) for 20 seconds at −6 kV, the light-sensitive material was allowed to stand for 10 seconds, and a surface potential $V_{10}A$ at the point of time was measured.

On the other hand, after exposing the light-sensitive material to a fluorescent lamp for 20 seconds at a distance of 2 meters (500 lux), the light-sensitive material was allowed to stand in a dark place for 10 seconds, and then a surface potential $V_{10}B$ was measured in the same manner as $V_{10}A$ above. The $V_{10}$ recovery ratio was calculated by the following equation: $(V_{10}B/V_{10}A)\times 100(\%)$.

Image-Forming Performance:

The light-sensitive material was allowed to stand one day in a dark place at 20° C. and 65% RH. Then, the light-sensitive material was subjected to the above described pre-exposure, thereafter charged to −5 kV, irradiated by scanning with a gallium-aluminum-arsenic semiconductor laser (oscillation wavelength: 780 nm) of 2.8 mW output as a light source in an exposure amount on the surface of 50 erg/cm$^2$, at a pitch of 25 μm and a scanning speed of 300 meters/sec., and then developed using ELP-T (manufactured by Fuji Photo Film Co., Ltd.) as a liquid developer followed by fixing. The duplicated image thus formed was visually evaluated for fog and image quality.

*4) Printing Property:

Background Stains of Light-Sensitive Material:

After subjecting the photoconductive layer surface of the light-sensitive material to an oil-desensitizing treatment by passing once the light-sensitive material through an etching processor using a solution obtained by diluting twice an oil-desensitizing solution (ELP-EX, manufactured by Fuji Photo Film Co., Ltd.) with distilled water, the light-sensitive material thus-treated was mounted on an offset printing machine (Oliver Type 52, manufactured by Sakurai Seisakusho K. K.) as an offset master plate for printing, and the extent of background stains occurred on prints was visually evaluated.

Printing Durability:

The light-sensitive material was subjected to the plate making under the same condition as described above for the image-forming performance of the pre-exposure. Then, the photoconductive layer of the master plate was subjected to an oil-desensitizing treatment by passing twice the master plate through the etching processor using the oil-desensitizing solution ELP-EX. The resulting plate was mounted on the offset printing machine in the same manner as described above as an offset master for printing, and the number of prints obtained without the occurrence of background stains in the non-image portions of the prints and problems on the image quality of the image portions was determined. The larger the number of the prints, the better the printing durability.

As is apparent from the results shown in Table 5, each of the electrophotographic light-sensitive materials according to the present invention had the photoconductive layer of good smoothness. Also, at the electrostatic charging, uniform charging property was observed without causing uneven charging. Further, under the condition wherein the light-sensitive material which had been pre-exposed prior to making a printing plate, the recovery was very good and the characteristics were almost the same as those obtained under no pre-exposure condition. The duplicated images had no background fog and the image quality was good. This is assumed to be based on that the photoconductive substance, the spectral sensitizer and the binder resin are adsorbed each other in an optimum state and the state is stably maintained.

Also, when the light-sensitive material was subjected to an oil-desensitizing treatment with an oil-desensitizing solution and a contact angle between the surface thus treated and a water drop was measured. The contact angle was as small as 10 degree or less, which indicated that the surface was sufficiently rendered hydrophilic. When printing was conducted, the background stains of the prints was not observed.

Furthermore, when a printing plate was prepared from the light-sensitive material and used, since the light-sensitive material had good charging property and pre-exposed fatigue resistance, the duplicated images obtained was clear and had no background fog. Thus, the oil-desensitization with an oil-desensitizing solution sufficiently proceeded and, after printing 10,000 prints, the prints had no background stains and showed clear image quality.

As shown in Example 2, when the electrophotographic light-sensitive material of the present invention contained the resin (A') having the methacrylate component of the specific substituent, the charging property and the pre-exposure fatigue resistance were more improved.

On the other hand, in Comparative Examples A and B each using a known low-molecular weight resin, the uneven charging occurred under the severe condition. Also, the pre-exposure fatigue was large which influenced on the image forming performance to deteriorate the quality of duplicated images (occurrence of background fog, cutting of fine lines and letters, decrease in density, etc.). Also, when the oil-desensitization treatment with an oil-desensitizing solution was conducted, it was confirmed that the light-sensitive materials in the comparative examples showed no background stains on the prints, and the surface of the photoconductive layer was sufficiently rendered hydrophilic. However, when the light-sensitive material for comparison was subjected to plate making and conducted the oil-desensitizing treatment, and used for printing as an offset master plate, prints obtained showed background stains in the non-image portions from the start of printing and the image quality of the image portions was deteriorated (cutting of fine lines and letters, decrease in density, etc.). This means that the degradation of the image quality of the master plate obtained by plate making appears on the prints as it is without being compensated by the oil-desensitizing treatment and, hence, the plate cannot be practically used.

With Comparative Example C using the conventionally known low-molecular weight resin alone, all the characteristics are almost same as the cases of Comparative Examples A and B. Further, since the film strength of the photoconductive layer was not sufficient, the layer was damaged after obtaining several hundred prints during the printing durability evaluation.

Thus, it can be seen that only the light-sensitive materials according to the present invention are excellent in all aspects of the smoothness of the photoconductive layer, electrostatic characteristics, and printing property.

EXAMPLES 3 TO 28

By following the same procedure as Example 1 except that 6.5 g of each of Resins (A) and 33.5 g of each of Resins (B) shown in Table 6 below were used in place of Resin (A-1) and Resin (B-1), each of the electrophotographic light-sensitive materials shown in Table 6 was produced.

TABLE 6

| Example No. | Resin (A) | Resin (B) |
|---|---|---|
| 3 | A-4 | B-1 |
| 4 | A-5 | B-1 |
| 5 | A-7 | B-2 |
| 6 | A-8 | B-3 |
| 7 | A-9 | B-3 |
| 8 | A-10 | B-4 |
| 9 | A-11 | B-5 |
| 10 | A-12 | B-6 |
| 11 | A-13 | B-7 |
| 12 | A-14 | B-8 |
| 13 | A-17 | B-9 |
| 14 | A-19 | B-10 |
| 15 | A-21 | B-10 |
| 16 | A-22 | B-11 |
| 17 | A-23 | B-12 |
| 18 | A-24 | B-13 |
| 19 | A-25 | B-14 |
| 20 | A-26 | B-15 |
| 21 | A-27 | B-16 |
| 22 | A-28 | B-16 |
| 23 | A-29 | B-17 |
| 24 | A-24 | B-18 |
| 25 | A-22 | B-19 |
| 26 | A-18 | B-20 |
| 27 | A-20 | B-11 |
| 28 | A-2 | B-8 |

As shown in Table 6 above, the light-sensitive materials of the present invention were excellent in the charging property, dark charge retention rate and photosensitivity, and provided clear duplicated images having no background fog even under the high-temperature and high-humidity conditions (30° C. and 80% RH) or the pre-exposure fatigue condition.

Furthermore, when each of the light-sensitive materials was subjected to plate making and used for printing as an offset printing master plate, more than 10,000 prints having clear images of no background stains were obtained.

EXAMPLES 29 TO 42

By following the same procedure as Example 1 except that 6 g of each of Resins (A) and 34 g of each of Resins (B) shown in Table 7 below were used as the binder resin and 0.018 g of Dye (II) shown below as used in placed of 0.018 g of Cyanine Dye (I), each of the electrophotographic light-sensitive materials was prepared.

Dye (II):

-continued

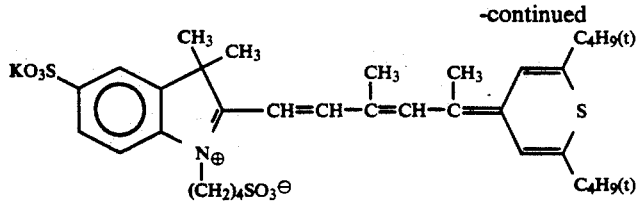

TABLE 8

| Example No. | Resin (A) | Resin (B) |
|---|---|---|
| 29 | A-1 | B-10 |
| 30 | A-4 | B-10 |
| 31 | A-5 | B-11 |
| 32 | A-6 | B-14 |
| 33 | A-7 | B-18 |
| 34 | A-9 | B-20 |
| 35 | A-10 | B-11 |
| 36 | A-13 | B-7 |
| 37 | A-14 | B-5 |
| 38 | A-15 | B-8 |
| 39 | A-19 | B-9 |
| 40 | A-22 | B-2 |
| 41 | A-24 | B-4 |
| 42 | A-26 | B-6 |

Each of the electrophotographic light-sensitive material of the present invention had excellent charging property and pre-exposure fatigue resistance, and, by the duplication using it under the severe conditions, clear images having no occurrence of background fog and cutting of fine lines were obtained. Furthermore, when printing was conducted using the offset printing master plate prepared therefrom, more than 10,000 prints having clear images of no background stains in the non-image portions were obtained.

EXAMPLE 43

A mixture of 6.5 g of Resin (A-2), 33.5 g of Resin (B-11), 200 g of zinc oxide, 0.03 g of uranine, 0.075 g of Rose Bengale, 0.045 g of bromophenol blue, 0.1 g of phthalic anhydride, and 240 g of toluene was dispersed by a homogenizer at $8\times10^3$ r.p.m. for 15 minutes to prepare a coating composition for a light-sensitive layer. The coating composition was coated on paper, which had been subjected to electrically conductive treatment, by a wire bar at a dry coverage of 25 g/m$^2$ followed by heating at 110° C. for 30 seconds, and then allowed to stand in a dark place for 24 hours at 20° C. and 65% RH to prepare an electrophotographic light-sensitive material.

COMPARATIVE EXAMPLE D

By following the same procedure as Example 43 except that 6.5 g of Resin (R-1) used in Comparative Example A described above was used in place of 6.5 g of Resin (A-2), an electrophotographic light-sensitive material was produced.

COMPARATIVE EXAMPLE E

By following the same procedure as Example 43 except that 6.5 g of Resin (R-2) used in Comparative Example B described above was used in place of 6.5 g of Resin (A-2), an electrophotographic light-sensitive material was produced.

COMPARATIVE EXAMPLE F

By following the same procedure as Example 43 except that 40 g of Resin (R-3) for comparison having the following formula was used in place of Resin (A-2) and Resin (B-11) as the binder resin, an electrophotographic light-sensitive material was produced.

Resin (R-3):

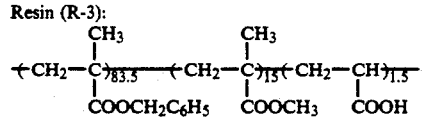

Mw: $4.8\times10^4$

On each of the light-sensitive materials thus prepared, the film property (surface smoothness), the charging property (occurrence of uneven charging), and the pre-exposure fatigue resistance were determined. Furthermore, each of the light-sensitive materials was used as an offset printing master plate, and the printing property (background stains and printing durability) of the resulting plate was determined.

The results obtained are shown in Table 8 below.

TABLE 8

| | Example 43 | Comparative Example D | Comparative Example E | Comparative Example F |
|---|---|---|---|---|
| Smoothness of Photoconductive Layer (sec/cc) | 350 | 380 | 400 | 370 |
| Charging Property (Uneven Charging) | Good (none) | Poor (uneven charging) | No Good (slight uneven charging) | Poor (uneven charging) |
| Pre-Exposure Fatigue Resistance | | | | |
| $V_{10}$ Recovery Ratio (%) | 92% | 65% | 75% | 67% |
| Image-Forming Performance[5)] | Very Good | Very Poor (reduced Dmax, backgroupd fog, scratches of fine lines) | Poor (reduced Dmax, backgroupd fog) | Poor (reduced Dmax, backgroupd fog) |
| Printing Property | | | | |
| Background Stains of Light-Sensitive Material | None | None | None | None |

TABLE 8-continued

| | Example 43 | Comparative Example D | Comparative Example E | Comparative Example F |
|---|---|---|---|---|
| Printing Durability[6)] | 10,000 | Background stains from the start of printing | Background stains from the start of printing | Background stains from the start of printing |

The image forming performance and the printing durability in Table 8 were evaluated as follows. The other evaluations were conducted in the same as described in Example 1.

*5) Image Forming Performance After Pre-exposure:

The light-sensitive material was allowed to stand one day in a dark place at 20° C. and 65% RH. Then, after conducting the pre-exposure under the same conditions as described in *3) above, the light-sensitive material was subjected to plate making by ELP-404V using ELP-T (toner), and the duplicated image obtained was visually evaluated.

*6) Printing Durability:

The light-sensitive material was subjected to the plate making under the same conditions as described in the image forming performance of *5) above. Then, the master plate was subjected to the oil-desensitizing treatment, the printing was conducted in the same manner as in the printing durability of *4) described above, and the resulting prints were evaluated.

The electrophotographic light-sensitive material of the present invention had a sufficient smoothness of the photoconductive layer, caused no uneven charging, and, also, even when pre-exposure was applied thereto, the effect of pre-exposure was recovered very quickly. Also, the duplicated images having no background fog were stably obtained. Further, when it was used as an offset printing plate, the non-image portions were sufficiently rendered hydrophilic and after printing 10,000 prints, further prints having clear images of no background stains were obtained.

On the other hand, with Comparative Examples D and E each using the known low-molecular weight resin, the charging property and pre-exposure fatigue resistance were lowered and, in the duplicated images formed, background fog, decrease in density, cutting of fine lines and letters were observed. Also, when the light-sensitive material was used as an offset master plate, stains occurred on the prints and the image quality of the prints was degraded. Thus, they could not be practically used. Although the sample of Comparative Example F was exhibited the same level of image forming performance as the sample of Comparative Example D, the damage of the photoconductive layer occurred after obtaining several hundred prints during the printing durability evaluation.

Thus, it can be seen that the electrophotographic light-sensitive material having sufficient electrostatic characteristics and printing suitability was obtained only in the case of using the binder resin according to the present invention.

EXAMPLES 44 TO 51

By following the same procedure as Example 43 except that 6.0 g of each of Resins (A) and 34.0 g of each of Resins (B) shown in Table 9 below were used in place of Resin (A-2) and Resin (B-11), each of the electrophotographic light-sensitive materials was produced.

TABLE 9

| Example No. | Resin (A) | Resin (B) |
|---|---|---|
| 44 | A-1 | B-2 |
| 45 | A-2 | B-5 |
| 46 | A-6 | B-8 |
| 47 | A-8 | B-11 |
| 48 | A-13 | B-16 |
| 49 | A-14 | B-10 |
| 50 | A-22 | B-18 |
| 51 | A-27 | B-20 |

The characteristics of each of the light-sensitive materials were determined in the same manner as in Example 43. The results indicated that each of the light-sensitive materials was excellent in charging property and pre-exposure fatigue resistance, and by the formation of the duplicated images under severe conditions, clear images having neither background fog nor cutting of fine lines were obtained.

Furthermore, when printing was conducted using the offset printing master plate obtained by plate making of the light-sensitive material, 10,000 prints having clear images of no background stains in the non-image portions were obtained.

EXAMPLE 52

A mixture of 6.5 g of Resin (A-30) shown below, 33.5 g of Resin (B-15), 200 g of zinc oxide, 0.03 g of uranine, 0.040 g of Methine Dye (III) shown below, 0.035 g of Methine Dye (IV) shown below, 0.15 g of salicylic acid, and 240 g of toluene was dispersed by a homogenizer at $1\times10^4$ r.p.m. for 10 minutes, then 0.5 g of glutaric anhydride was added thereto and further dispersed by a homogenizer at $1\times10^3$ r.p.m. for one minute to prepare a coating composition for a light-sensitive layer.

The coating composition was coated on paper, which had been subjected to electrically conductive treatment, by a wire bar at a dry coverage of 25 g/m$^2$ followed by heating at 110° C. for 15 seconds and, after further heating at 140° C. for 2 hours, allowed to stand for 24 hours in a dark place at 20° C. and 65% RH to prepare an electrophotographic light-sensitive material.

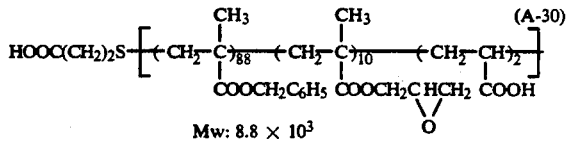

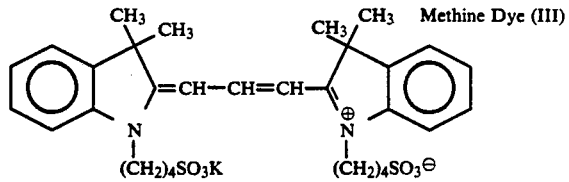

-continued

Methine Dye (IV)

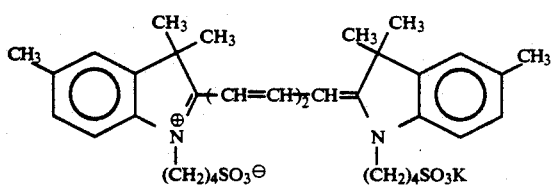

The characteristics of the light-sensitive material were determined in the same manner as in Example 43.

The smoothness of the photoconductive layer was 225 (sec/cc) and the charging property was uniform and good. The pre-exposure fatigue resistance was the $V_{10}$ recovery ratio of 93% and the image forming performance was good. Also, when it was subjected to the oil-desensitizing treatment and used as an offset printing mater plate, no background stains were observed. When printing was conducted using the printing plate prepared therefrom, more than 10,000 prints having clear images of no background stains were obtained.

EXAMPLES 53 TO 56

By following the same procedure as Example 52 except that each of the compounds shown in Table 10 below was used in place of 6.5 g of Resin (A-30) and 0.5 g of glutaric anhydride as crosslinking agent, and also 33 g of Resin (B-16) was used in place of Resin (B-15), each of the electrophotographic light-sensitive materials was produced.

TABLE 10

| Example No. | Resin (A) | Resin (A) (weight ratio) | Crosslinking Agent and Amount Used |
|---|---|---|---|
| 53 | (A-31) | 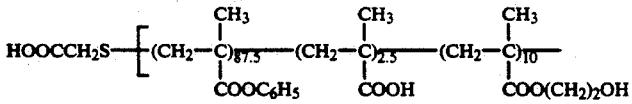 Mw: $7 \times 10^3$ | 1,6-Hexanediisocyanate 1 g |
| 54 | (A-32) | 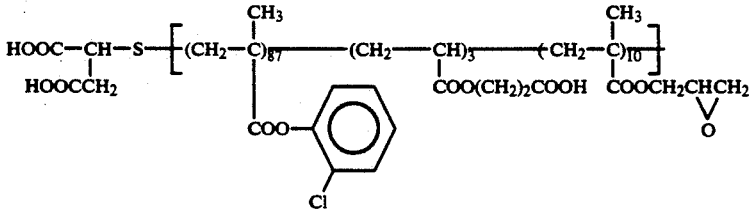 Mw: $6 \times 10^3$ | 3-(N,N-dimethylamino)-propylamine 0.8 g |
| 55 | (A-33) | 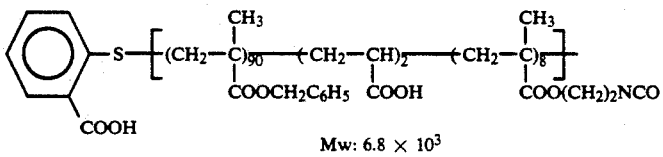 Mw: $6.8 \times 10^3$ | 1,6-Butanediol 0.8 g |
| 56 | (A-34) | 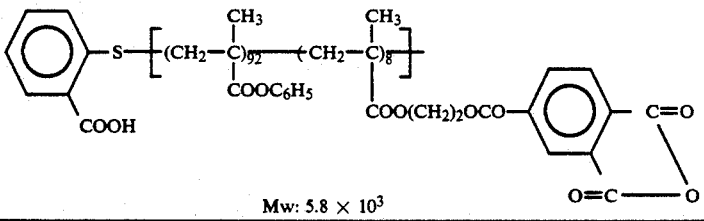 Mw: $5.8 \times 10^3$ | Hexamethylenediamine 0.6 g |

With each of the light-sensitive material, the characteristics were evaluated same as in Example 43.

As a result, each light-sensitive material was good in the charging property and pre-exposure fatigue resistance, and by the formation of duplicated image even under severe conditions, clear images of neither background fog nor cutting of fine lines were obtained. Furthermore, when it was used as an offset master printing plate after making printing plate, more than 10,000 prints having clear images of no background stains in the non-image portions were obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising a support having provided thereon a photoconductive layer containing at least an inorganic photoconductive substance, a spectral sensitizer and a binder resin, wherein the binder resin contains (1) at least one resin (Resin (A)) having a weight average molecular weight of from $1 \times 10^3$ to $1 \times 10^4$ which contains at least 30% by weight of a polymer component represented by the general formula (I) described below and from 0.1 to 10% by weight of a polymer component containing at least one acidic group selected from

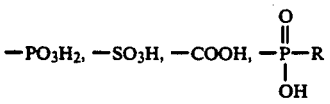

(wherein R represents a hydrocarbon group or —OR' (wherein R' represents a hydrocarbon group)) and a cyclic acid anhydride-containing group, and which has at least one acidic group selected from the above-described acidic groups at one terminal of the main chain of the copolymer;

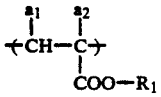

(I)

wherein $a_1$ and $a_2$ each represents a hydrogen atom, a halogen atom, a cyano group or a hydrocarbon group; and $R_1$ represents a hydrocarbon group; and (2) at least one graft type copolymer (Resin (B)) having a weight average molecular weight of from $3\times10^4$ to $1\times10^6$ and containing, as a copolymerizable component, at least one monofunctional macromonomer (M) having a weight average molecular weight of from $1\times10^3$ to $2\times10^4$ and comprising an AB block copolymer composed of an A block comprising at least one polymerizable component containing at least one acidic group selected from

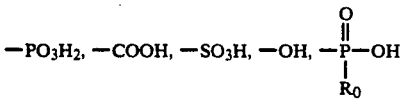

(wherein $R_0$ represents a hydrocarbon group or —$OR_0$' (wherein $R_0$' represents a hydrocarbon group)) and a cyclic acid anhydride-containing group, and a B block containing at least one polymerizable component represented by the general formula (III) described below and having a polymerizable double bond group bonded to the terminal of the main chain of the B block polymer.

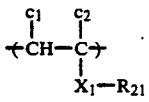

(III)

wherein $c_1$ and $c_2$ each represents a hydrogen atom, a halogen atom, a cyano group, a hydrocarbon group, —$COOR_{24}$ or —$COOR_{24}$ bonded via a hydrocarbon group (wherein $R_{24}$ represents a hydrocarbon group); $X_1$ represents —COO—, —OCO—, $-(CH_2)_{l_1}OCO-$, $-(CH_2)_{l_2}COO-$ (wherein $l_1$ and $l_2$ each represents an integer of from 1 to 3),

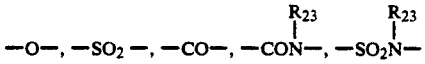

(wherein $R_{23}$ represents a hydrogen atom or a hydrocarbon group),

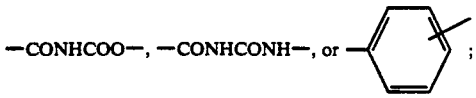

and $R_{21}$ represents a hydrocarbon group, provided that, when $X_1$ represents

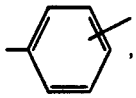

$R_{21}$ represents a hydrogen atom or a hydrocarbon group.

2. An electrophotographic light-sensitive material as claimed in claim 1, wherein the polymer component represented by the general formula (I) is a polymerizable component represented by the following general formula (IIa) or (IIb):

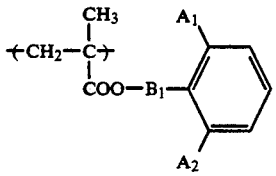

(IIa)

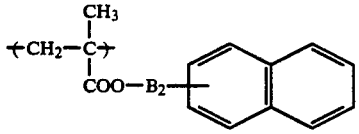

(IIb)

wherein $A_1$ and $A_2$ each represents a hydrogen atom, a hydrocarbon group having from 1 to 10 carbon atoms, a chlorine atom, a bromine atom, —$COD_1$ or —$COOD_2$, wherein $D_1$ and $D_2$ each represents a hydrocarbon group having from 1 to 10 carbon atoms; and $B_1$ and $B_2$ each represents a mere bond or a linking group containing from 1 to 4 linking atoms, which connects —COO— and the benzene ring.

3. An electrophotographic light-sensitive material as claimed in claim 2, wherein the linking group containing from 1 to 4 linking atoms represented by $B_1$ or $B_2$ is $-(CH_2)_{n_1}$ ($n_1$ represents an integer of 1, 2 or 3), —$CH_2OCO$—, —$CH_2CH_2OCO$—, —$CH_2O)_{n_2}$ ($n_2$ represents an integer of 1 or 2), or $-(CH_2CH_2O)-$.

4. An electrophotographic light-sensitive material as claimed in claim 1, wherein the content of the polymer component represented by the general formula (I) is from 50 to 97% by weight.

5. An electrophotographic light-sensitive material as claimed in claim 1, wherein the content of the polymer component containing the acidic group in the resin (A) is from 0.5 to 8% by weight.

6. An electrophotographic light-sensitive material as claimed in claim 1, wherein the acidic group which is bonded to the terminal of the polymer main chain of the resin (A) is

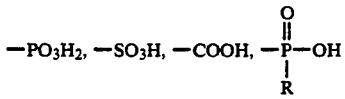

or a cyclic acid anhydride-containing group.

7. An electrophotographic light-sensitive material as claimed in claim 1, wherein the resin (A) further contains from 1 to 20% by weight of a copolymer component having a heat- and/or photo-curable functional group.

8. An electrophotographic light-sensitive material as claimed in claim 7, wherein the photoconductive layer further contains a crosslinking agent.

9. An electrophotographic light-sensitive material as claimed in claim 1, wherein the acidic group contained in a component constituting the A block of the macromonomer (M) is

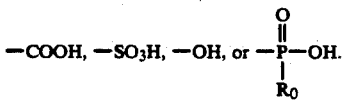

10. An electrophotographic light-sensitive material as claimed in claim 1, wherein the polymerizable double bond is a group represented by the following general formula (V):

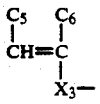

(V)

wherein $c_5$ and $c_6$ each represents a hydrogen atom, a halogen atom, a cyano group, a hydrocarbon group, $-COOR_{24}$ or $-COOR_{24}$ bonded via a hydrocarbon group (wherein $R_{24}$ represents a hydrocarbon group; and $X_3$ represents —COO—, —OCO—, $-(CH_2)_{l_1}OCO-$, $-(CH_2)_{l_2}COO-$ (wherein $l_1$ and $l_2$ each represents an integer of from 1 to 3),

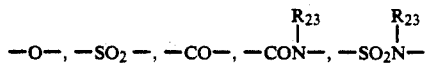

(wherein $R_{23}$ represent a hydrogen atom or a hydrocarbon group),

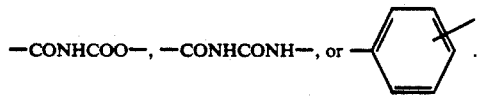

11. An electrophotographic light-sensitive material as claimed in claim 1, wherein a ratio of the A block/the B block in the resin (B) is 1 to 30/99 to 70 by weight.

12. An electrophotographic light-sensitive material as claimed in claim 1, wherein the resin (B) contains the macromonomer (M) and a polymer component represented by the following general formula (IV):

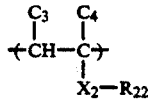

(IV)

wherein $c_3$ and $c_4$ each represents a hydrogen atom, a halogen atom, a cyano group, a hydrocarbon group, $-COOR_{24}$ or $-COOR_{24}$ bonded via a hydrocarbon group (wherein $R_{24}$ represents a hydrocarbon group; $X_2$ represents —COO—, —OCO—, $-(CH_2)_{l_1}OCO-$, $-(CH_2)_{l_2}COO-$ (wherein $l_1$ and $l_2$ each represents an integer of from 1 to 3),

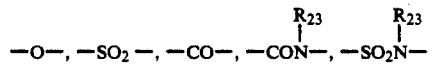

(wherein $R_{23}$ represent a hydrogen atom or a hydrocarbon group),

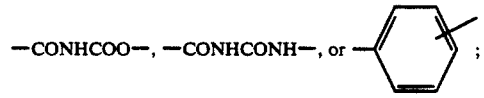

and $R_{22}$ represents a hydrocarbon group, provided that, when $X_2$ represents

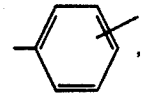

$R_{22}$ represents a hydrogen atom or a hydrocarbon group.

13. An electrophotographic light-sensitive material as claimed in claim 12, wherein a ratio of the macromonomer (M) to a monomer corresponding to the polymer component of the general formula (IV) is 1 to 60/99 to 40 by weight.

14. An electrophotographic light-sensitive material as claimed in claim 1, wherein a ratio of the resin (A)/the resin (B) is 5 to 50/95 to 50 by weight.

* * * * *